US006119500A

United States Patent [19]

Ginzburg et al.

[11] Patent Number: 6,119,500

[45] Date of Patent: Sep. 19, 2000

[54] INVERSE SYMMETRICAL VARIABLE CROWN ROLL AND ASSOCIATED METHOD

[75] Inventors: Vladimir B. Ginzburg; Roy J. Issa, both of Pittsburgh, Pa.

[73] Assignees: Danieli Corporation, Cranberry Township; International Rolling Mill Consultants, Inc., Pittsburgh, both of Pa.

[21] Appl. No.: 09/315,557

[22] Filed: May 20, 1999

[51] Int. Cl.[7] ..... B21B 31/07

[52] U.S. Cl. ..... 72/247; 72/10.1; 72/13.4; 72/31.08; 72/252.5; 72/366.2

[58] Field of Search ..... 72/12.1, 13.4, 72/247, 252.5, 366.2, 10.1, 10.4, 13.5, 14.1, 31.08

[56] References Cited

U.S. PATENT DOCUMENTS

| | | | |
|---|---|---|---|
| 3,857,268 | 12/1974 | Kajiwaka | 72/247 |
| 3,943,742 | 3/1976 | Kajiwara et al. | 72/247 |
| 4,162,627 | 7/1979 | Shida et al. | 72/247 |
| 4,320,643 | 3/1982 | Yasuda et al. | 72/8 |
| 4,440,012 | 4/1984 | Feldmann et al. | 72/201 |
| 4,519,233 | 5/1985 | Feldmann et al. | 72/247 |
| 4,656,859 | 4/1987 | Ginzburg | 72/243 |
| 4,781,051 | 11/1988 | Schultes et al. | 72/247 |
| 4,803,865 | 2/1989 | Jansen et al. | 72/245 |
| 4,955,221 | 9/1990 | Feldmann et al. | 72/247 |
| 5,174,144 | 12/1992 | Kajiwara et al. | 72/252.5 |
| 5,640,866 | 6/1997 | Satoh et al. | 72/252.5 |

FOREIGN PATENT DOCUMENTS

| | | | |
|---|---|---|---|
| 59-61511 | 4/1984 | Japan | 72/247 |
| 62-282717 | 12/1987 | Japan | 72/247 |
| 6-15309 | 1/1994 | Japan . | |
| 1519798 | 11/1989 | U.S.S.R. | 72/252.5 |

*Primary Examiner*—Ed Tolan
*Attorney, Agent, or Firm*—Armstrong, Westerman, Hattori, McLeland & Naughton

[57] ABSTRACT

The method and apparatus of the present invention is a rolling mill having rolls with inverse symmetrical profiles and a method of using the same. An inverse symmetrical profile is a profile in which the right and left sides of a roll, with respect to the roll center line, have the profiles that are described by the same polynomial function but with opposite signs. A family of metal strip profiles can be created by the method and apparatus of the present invention wherein the family of strip profiles created prior to roll shifting are strip profiles expressed by polynomial functions having terms of the $n^{th}$ order, where n is preferably 1–5 inclusive, and the family of strip profiles produced by shifting at least one upper roll having an inverse symmetrical profile and at least one lower roll having an inverse symmetrical profile are strip profiles expressed by polynomial functions having terms of the $(n-1)^{th}$ order, where n is preferably 1–5, inclusive.

17 Claims, 23 Drawing Sheets

INVERSE SYMMETRICAL VARIABLE CROWN ROLL AND ASSOCIATED METHOD

FIELD OF THE INVENTION

The present invention is a method and apparatus for the reduction of local roll wear in a rolling mill as well as the correction of a variety of metal strip profiles in a rolling mill.

BACKGROUND OF THE INVENTION

Strip profiles have many common shapes identified as flat or rectangular, heavy center or convex light center or concave. Often it is desired to produce finished metal strip having a convex profile. Further it is not just the convex, profile that is important, but it is the shape of the convex profile that is critical. To this end, it is often desirable to produce a convex profile that is polynomial. In other words, the convex profile, specifically the curvature of the top and bottom edges, can be described mathematically by a polynomial function.

Obtaining a convex profile that is polynomial is typically performed by at least one of the two known methods, roll bending or roll shifting. Roll bending refers to placing load on the journaled ends of the work rolls of a mill stand, typically only the top work roll, in order to bend the work rolls, and thus to modify the metal strip profile.

The basic functions of positive roll bending are to increase the reduction at the center of the strip and to reduce the reduction at the edges of the strip. Conversely, negative work roll bending gives increased reduction at the edges of the strip and can lead to a decrease in the reduction at the center of the strip.

The other way to correct the profile of a metal strip is by roll shifting which refers to axially shifting at least one non-cylindrical roll in the mill stand. Axially shifting at least one non-cylindrical roll, changes the shape of the space between the work rolls. This space between the work rolls defines the roll gap. Changing the roll gap by roll shifting can also cause the "correction" of a strip profile to create a polynomial profile. Correcting a strip profile involves altering the curvature of the surfaces of the metal strip without changing the gauge of the strip. The change in the strip profile is dependent on the shape of the roll, work roll, intermediate roll or backup roll, that is shifted. Not all roll shapes or combinations thereof can create a roll gap that will correct a strip profile to produce a polynomial profile. Correction of strip profile by roll shifting is dependent on the shape of the non-cylindrical roll or rolls that are shifted as well as the shape of the strip profile to be corrected.

Roll bending and roll shifting create various strip profiles. Various strip profiles created on a rolling mill by roll bending and roll shifting are referred to as a family of strip profiles. A family of strip profiles comprise a strip profile envelope. The greater the strip profile envelope the greater the capability of the mill to produce desired profiles.

One example of prior art roll shifting is the so-called continuously variable crown, or CVC, rolling in which the work rolls and backup rolls have an S- or bottle-shaped profile which provides for adjustment of the roll gap profile by bi-directional shifting of the rolls. Disadvantages of the CVC system are that it requires special, asymmetrical roll grinding, and produces an asymmetrical backup roll wear pattern. Moveover, it does not provide sufficient improvement to avoid the need for use of several sets of rolls for rolling a range of sheet or strip of various sizes which can be rolled in a given mill.

When the material is rolled between the curved initial crown portions of the upper and lower work rolls, a variation of the roll gap is small even if the upper and lower work rolls are axially shifted, and by compensating for this variation by roll bending, the work rolls can be cyclically shifted axially within a predetermined range. By doing so, the wear of the work rolls due to the rolling is dispersed, the initial crown of the work rolls can be maintained for a long period of time. As a result, it is possible to perform the rolling operation of the wide material after- the rolling operation of the narrow material is performed, and the limitation on the order of the rolling operation with respect to the width of the material to be rolled can be eliminated.

OBJECTS OF THE INVENTION

It is the principal object of the invention to provide a method and an apparatus to provide a family of strip profiles in a rolling mill for the purpose of correcting a large variety of strip profiles.

It is an object of the present invention to provide a method and apparatus for reducing local roll wear on the work rolls of the rolling mill.

It is another object of the present invention to provide a method and apparatus that can achieve precise workpiece profile control by economical and efficient means.

It is still another object of the present invention to provide a mill stand which is compatible with existing rolling mill technology.

It is a further object of the invention to provide a large strip profile envelope.

Other objects, features and advantages of the present invention will become apparent from the following detailed description taken in conjunction with the accompanying drawings.

SUMMARY OF THE INVENTION

The present invention is a method and apparatus for the reduction of local roll wear in a rolling mill as well as the correction of a variety of metal strip profiles in the same. This can be accomplished using rolls having inverse symmetrical profiles. An inverse symmetrical profile is a profile in which the right and left sides of a roll, with respect to the roll center line, have the profiles that are described by the same polynomials but with opposite signs. The method and apparatus of the present invention is a rolling mill having rolls with inverse symmetrical profiles and a method of using the same. A family of metal strip profiles can be created by the method and apparatus of the present invention wherein the family of strip profiles created prior to roll shifting are strip profiles expressed by polynomial functions having terms of the $n^{th}$ order, where n is preferably 1–5 inclusive, and the family of strip profiles produced by shifting at least one upper roll having an inverse symmetrical profile and at least one lower roll having an inverse symmetrical profile are strip profiles expressed by polynomial functions having terms of the $(n-1)^{th}$ order, where n is preferably 1–5, inclusive.

DETAILED DESCRIPTION OF THE INVENTION

Figure 1A:
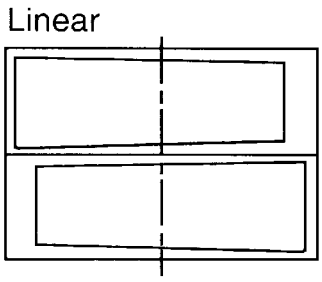
FIG. 1a Prior Art
FIG. 1*a* is a profile form of two linear rolls of the prior art.
Figure 1B:
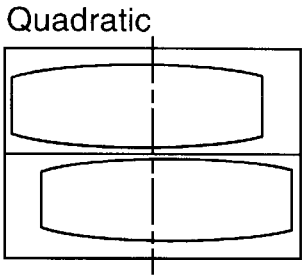
FIG. 1b Prior Art
FIG. 1*b* is a profile form of two quadratic rolls of the prior art.
Figure 1C:
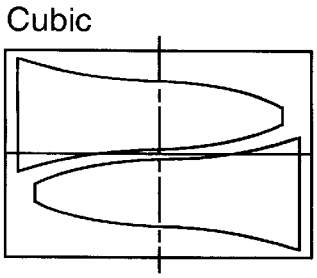
FIG. 1c Prior Art
FIG. 1*c* is a profile form of two cubic rolls of the prior art.
Figure 1D:
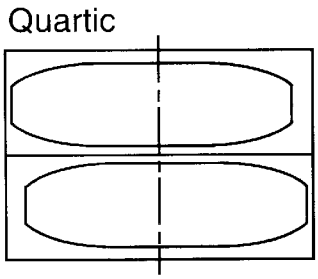
FIG. 1d Prior Art
FIG. 1*d* is a profile form of two quartic rolls of the prior art.
Figure 1E:
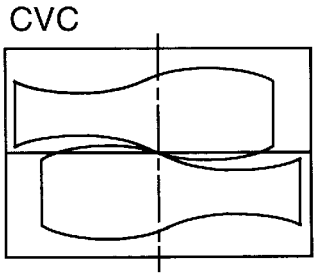
FIG. 1e Prior Art
FIG. 1*e* is a profile form of two CVC rolls of the prior art.
Figure 1F:
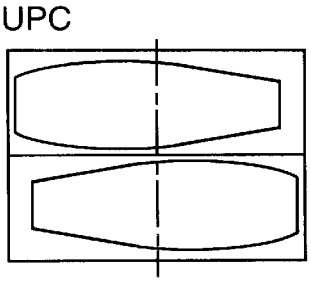
FIG. 1f Prior Art
FIG. 1*f* is a profile form of two UPC rolls of the prior art.
Figure 1G:
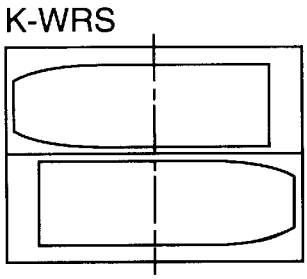
FIG. 1g Prior Art
FIG. 1*g* is a profile form of two K-WRS rolls of the prior art.

The present invention is directed toward an efficient and flexible apparatus and method for correcting strip profiles characterized by different and varying polynomial functions. The apparatus and method of the present invention uses a mill stand having a housing for mounting rolls so that they are journaled in roll chocks and at least two rolls, for example, work rolls, intermediate rolls or backup rolls, having an inverse symmetrical profile, referred to as inverse symmetrical variable crown (IVC) rolls. A mill having IVC rolls is referred to as an inverse symmetrical variable crown rolling mill (IVC mill). An inverse symmetrical profile is a profile in which the right and left sides of a roll, with respect to the roll center line, have the profiles that are described by the same polynomials but with opposite signs. In other words, the amount of deviation on the right and left sides of the roll from a cylindrical profile is the same but in opposite directions.

It is important for metal strip producers, particularly steel producers, to control the shape of the finished metal strip, the cross section of which shows the variation in strip profile. Hot rolling a metal strip allows a producer to directly control the shape, and hence the strip profile, because the heated metal is workable and hot rolling shapes the profile of the metal strip. Contrary to the cold rolling process, a producer does not want to change the relative strip profile (ratio of the strip crown to strip thickness in the center of the strip) because changing the profile will cause flatness problems in the metal strip. Instead the strip profile is "corrected" in a finishing mill.

Correcting a strip profile involves altering the curvature of the surfaces of the metal strip without changing the gauge of the strip. Changing the strip profile by changing the gauge or changing the location of a crown in the strip causes flatness problems, so it is desired to avoid these types of changes.

A metal strip has a top and bottom surface, two side surfaces and two end surfaces. The top and bottom surfaces of the strip have the largest surface area. The strip profile, described by the cross section of the metal strip, is defined by four edges, top and bottom edges corresponding to the top and bottom surfaces of the metal strip and two side edges, corresponding to the two side surfaces.

There are many different profiles and combinations of profiles of mill rolls. The most common mill rolls are the following which are shown in FIGS. 1*a–g* and defined by the function f(Y) which is a polynomial function where x=distance from the center of the roll:

| | |
|---|---|
| Linear | $Y = 0.02x$ |
| Quadratic | $Y = 0.002x^2$ |
| Cubic | $Y = 0.0001x^3$ |
| Quartic | $Y = 0.000002x^4$ |
| CVC roll | $Y = 0.0001634x^3 - 0.3021x$ |
| UPC roll | $Y = -0.00002374x^3 + 0.002590X^2 + 0.05640x$ |
| K-WRS roll | $Y = 0.00000081x^4 - 0.000034x^3 - 0.000293x^2 + 0.015x$ |

In designing the roll profile, four principal factors must be considered: The first factor is the compatibility of the roll gap profile change caused by roll shifting with the desired change of the strip profile. When the rolls having polynomial profile of the $n^{th}$ order are shifted, the shift produces a change of the strip profile that is expressed by a polynomial of the $(n-1)^{th}$ order. For example, the profile of the CVC roll (FIG. 1*e*) is expressed by the polynomial that contains components of the third and the first orders, where "$a_n$" (n=3 and 1) is a constant, as shown in equation (1):

$$y=a_3X^3-a_1X \tag{1}$$

The shifting of the CVC rolls will result in a change in the strip profile that is expressed by the polynomial that contains a component of the second order of polynomial, as shown in equation (2):

$$y=a_2X^2 \tag{2}$$

However, a real strip profile contains other components of the polynomial with both lower and higher orders. From a practical point of view, the strip profile can be accurately presented by the polynomial that contains the components of the first, second, third, and fourth orders, where $a_N$ is a constant as shown in equation (3):

$$a_4X^4+a_3X^2+a_1X \tag{3}$$

If the strip profile is described by a polynomial with components of the first, second, third and fourth orders, then the polynomial of the roll profile must contain the components of the first, second, third, fourth, and fifth orders as shown in equation (4):

$$y=a_5x^5+a_4X^4+a_3X^3+a_2X^2+a_1x \tag{4}$$

None of the known roll profile polynomials (FIGS. 1*a–g*) contains components with the order higher than fourth, as listed above.

The second factor is the effectiveness of the roll shifting "E." This factor is defined as the ratio of the change in the strip profile, Δc, to the roll shifting stroke, s, as shown in equation (5):

$$E = \frac{\Delta c}{s} \tag{5}$$

The shorter the roll shifting stroke, s, that can produce the same change in strip profile, Δc, the more effective the roll shifting actuator is. To increase the effectiveness of the roll shifting E it is necessary to use a roll profile that curles both up and down in respect to a roll axis. Among the known roll profiles, only cubic and CVC profiles meet this requirement.

The third factor is the shape of the roll contact between the rolls. To reduce the local contact stresses it is desirable to avoid "bulging" shapes in the roll such as typical for quadratic (FIG. 1*b*), CVC (FIG. 1*e*), and UPC (FIG. 1*f*) roll shapes.

The fourth factor is the simplicity of grinding the roll profile. In the conventional rolls, the roll profile is symmetrical with resect to the center line of the roll. It permits to use of standard grinding machines achieve a very high precision with which the roll profile can economically be made. All known roll profiles that are used with shifting rolls are non-symmetrical. This means they are not symmetrical with respect to the roll center line. To grind this profile, more expensive grinding machines are required. The non-symmetrical roll profile is unavoidable to produce the effect of roll shifting on strip profile. However, it is possible to simplify the grinding process by employing the inverse symmetrical profile in which the right and left parts of the rolls in respect to the roll center line have the profiles that are described by the same polynomials with opposite signs, such as, where "a" is a constant:

$$\text{left side of the roll: } y=a_4X^4+a_3X^3+a_2X^2+a_1x \quad (6)$$

$$\text{right side of the roll: } y=-a_4x^4-a_3X^3-a_2X^2-a_1x. \quad (7)$$

The inverse symmetrical profile is possible to produce with standard grinding machines with very high accuracy. In summary, none of the known roll profiles meets all four requirements described above. The rolls with an inverse symmetrical profile, however, meets all these requirements.

The rolling apparatus and method of the present invention uses rolls with an inverse symmetrical profile (IVC rolls). By using IVC rolls, one can reduce local roll wear in a rolling mill as well as correct a variety of metal strip profiles in the same.

First, a prior art rolling mill stand employing variable crown rolls is described in U.S. Pat. No. 4,656,859 and illustrated in FIG. 2, as a schematic representation of a 4-hi mill stand. An upper backup roll 2 is inversely symmetrical and rotatable about a longitudinal axis 4. In other words, upper backup roll 2 has a concave portion 6 which is outwardly concave and an adjacent convex portion 8. The upper backup roll 2 diverges from a smaller end 10 to a larger end 12. As indicated in the drawing, at a distance X from the center of the roll 2, indicated by the center line, the vertical deviation from the center where X=0 is equal to Y on both the left and right sides of upper backup roll 2.

An upper work roll 14 which is arranged to contact with upper backup roll 2 is rotatable about a longitudinal axis 16. The upper work roll 14 has a concave portion 18 for contact with convex portion 8 of the upper backup roll 2. The upper work roll 14 also has a cylindrical portion 20 for contact with concave portion 6.

Below upper work roll 14 is a lower work roll 22 which is rotatable about a longitudinal axis 24. Lower work roll 22 has a cylindrical portion 26 on one end and a convex portion 28 on the opposite end. Lower work roll 22 is in contact with a lower backup roll 30 which has a longitudinal axis 32, a convex portion 34 and a concave portion 36. Convex portion 34 is for contact with cylindrical portion 26 and concave portion 36 is for contact with convex portion 28 of lower work roll 22. As indicated in the drawing, at a distance X from the center of the roll 30, indicated by the center line, the vertical deviation from the center where X=0 is equal to Y on both the left and right sides of lower backup roll 30.

Figure 2:
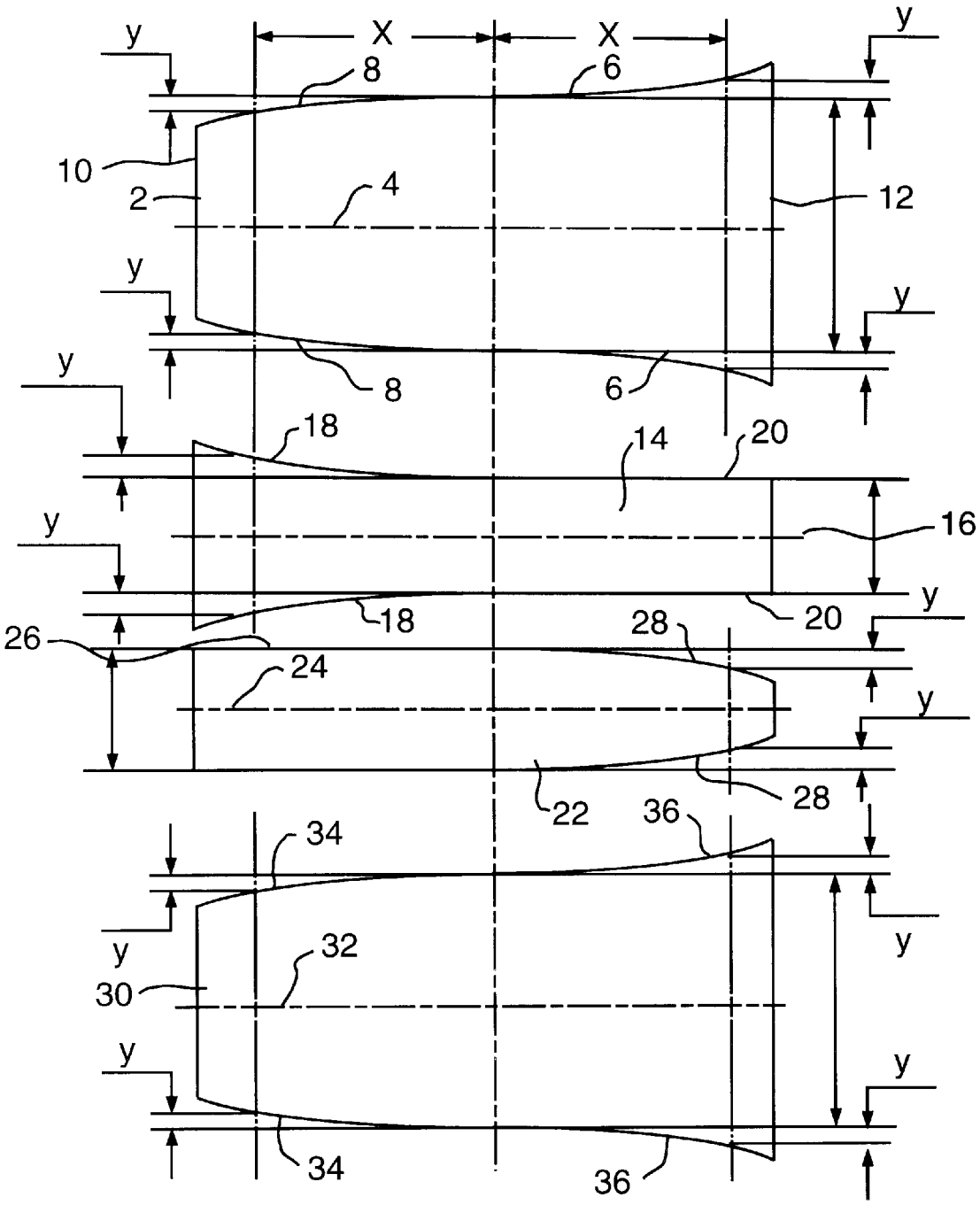
FIG. 2 Prior Art
FIG. 2 is a profile form of two backup rolls and two work rolls of the prior art.
Figure 5:
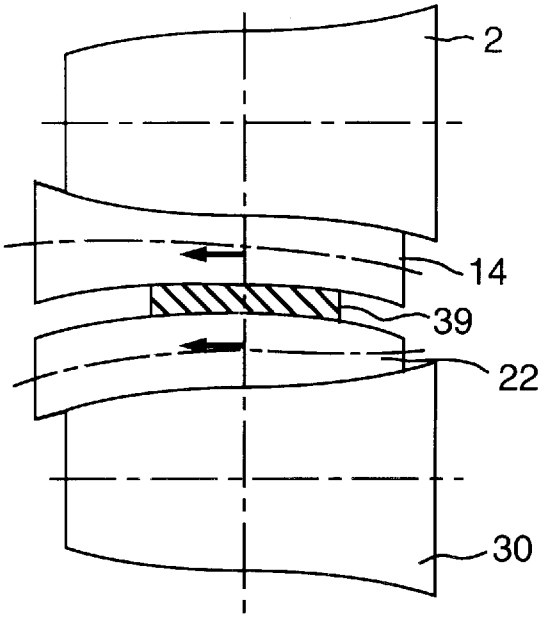
FIG. 5 Prior Art
FIG. 5 is a schematic cross-sectional illustration of a 4-hi mill stand of the prior art with the work rolls shifted to produce a strip with a concave profile.
Figure 5A:
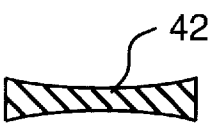
FIG. 5a Prior Art
FIG. 5*a* is a strip profile produced by the mill stand of FIG. 5.
Figure 4:
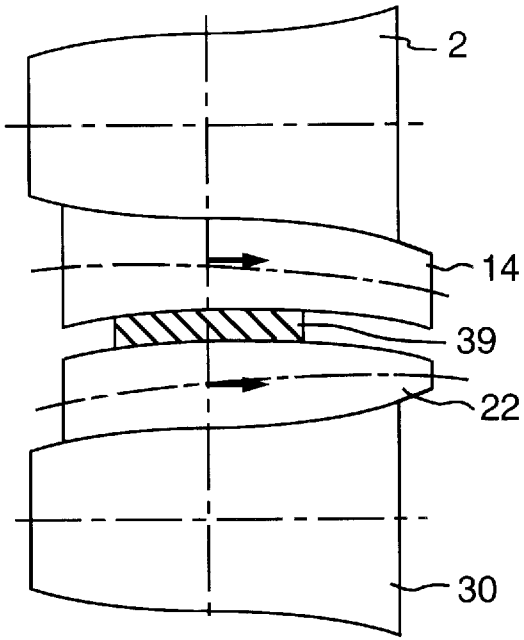
FIG. 4 Prior Art
FIG. 4 is a schematic cross-sectional illustration of a 4-hi mill stand of the prior art with the work rolls shifted to produce a strip with a convex profile.
Figure 4A:
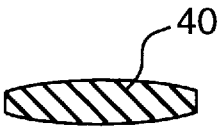
FIG. 4a Prior Art
FIG. 4*a* is a strip profile produced by the mill stand of FIG. 4.
Figure 3:
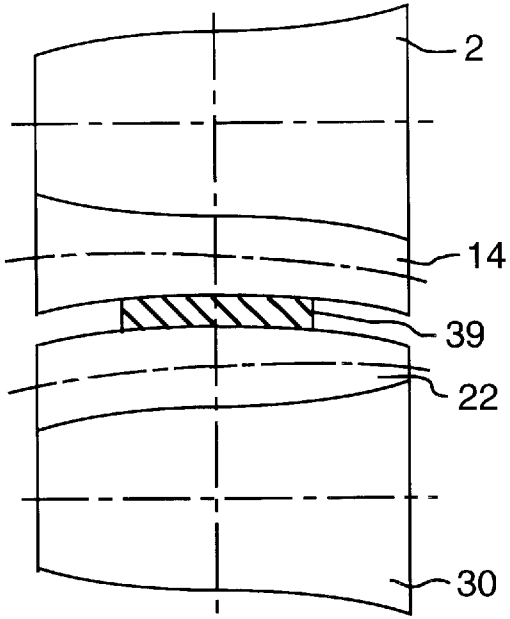
FIG. 3 Prior Art
FIG. 3 is a schematic cross-sectional illustration of a 4-hi mill stand of the prior art with the work rolls positioned to produce a generally flat strip.
Figure 3A:
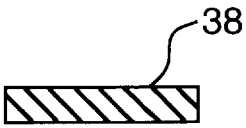
FIG. 3a Prior Art
FIG. 3*a* is a strip profile produced by the mill stand of FIG. 3.

In this known system, the upper work roll 14 and the lower work roll 22 can be shifted to create various strip profiles for substantially flat, convex and concave metal strip. The operation of the mill stand of FIG. 2 is shown in FIGS. 3–5. In this mill stand configuration, uni-directional shifting of upper work roll 14 and lower work roll 22 can create variable strip profiles as illustrated in FIGS. 3*a*–5*a*. In FIG. 3, the upper work roll 14 and lower work roll 22 are positioned to produce a generally flat strip profile 38, as in FIG. 3*a*, from a metal strip 39. In FIG. 4, upper work roll 14 and lower work roll 22 are shifted to produce a convex strip profile 40, as in FIG. 4*a*, from metal strip 39 and in FIG. 5, upper work roll 14 and lower work roll 22 are shifted to produce a concave strip profile 42, as in FIG. 5*a*, from metal strip 39. The drawback of the mill stands of FIG. 4 and FIG. 5 is that both upper work roll 14 and lower work roll 22 must be shifted and the rolls will wear especially at the location near the edges of the metal strip between upper work roll 14 and lower work roll 22. Local roll wear can be alleviated by roll shifting.

Generally, the axial shifting of rolls in a rolling mill is employed to perform the following functions:

1) reduce local roll wear near strip edges; and 2) provide variable profiles of the roll gap.

The first goal is achieved by employing generally cylindrical rolls and by their periodic axial shifting after rolling a certain number of coils. The amount of shifting and the number of coils prior to next shifting greatly affect the efficiency of this procedure. These parameters depend on the rolled product geometry and hardness. A typical roll shifting pattern would involve shifting the rolls by 20 mm after rolling one coil.

The second goal is achieved by employing mill rolls with non-cylindrical profiles. The axial shifting of the top and bottom rolls can be either in the same or in opposite directions, in other words the rolls can be shifted toward each other or away from each other.

The work rolls that are used for uni-directional shifting, as in FIGS. 2–5, usually have the profiles that are described by one of the polynomial functions listed above (FIGS. 1*a*–*g*). The main problem of this system is that it requires shifting of both work rolls. Another problem is due to the fact that the pattern of work roll shifting for achieving optimum strip profile does not coincide with the roll shifting pattern required for optimum reduction of local roll wear. Therefore, the uni-directional shifting can accomplish only one function at a time.

In the known system, as shown in FIG. 2, the variable strip profile is achieved by employing IVC backup rolls. The work rolls, however, have different profiles. One side of the work roll is non-cylindrical, either expanding or contracting, while the other side is cylindrical. Uni-directional shifting of both work rolls with respect to the backup rolls (FIGS. 3–5) produces a variable strip profile. The unidirectional shifting permits the use of a simplified roll shifting mechanism in comparison with bi-directional shifting. However, it does not alleviate the problem with local roll wear on the work rolls.

The present invention can create a variable strip profile and simultaneously during the operation, reduce local roll wear. The apparatus of the present invention (FIG. 6), for correcting strip profile and reducing local roll wear, has a cylindrical work roll 44 and an IVC work roll 46. The apparatus also has an upper IVC backup roll 48 and a lower IVC backup roll 50. The apparatus can have more than one upper or lower backup roll. The apparatus also has a housing (not shown) for mounting the rolls and a means for shifting at least the upper IVC work roll 46. For each IVC roll, at a distance X from the center of the roll, indicated by the center line, the vertical deviation from the center where X=0 is equal to Y on both the left and right sides of the IVC roll.

Figure 6:
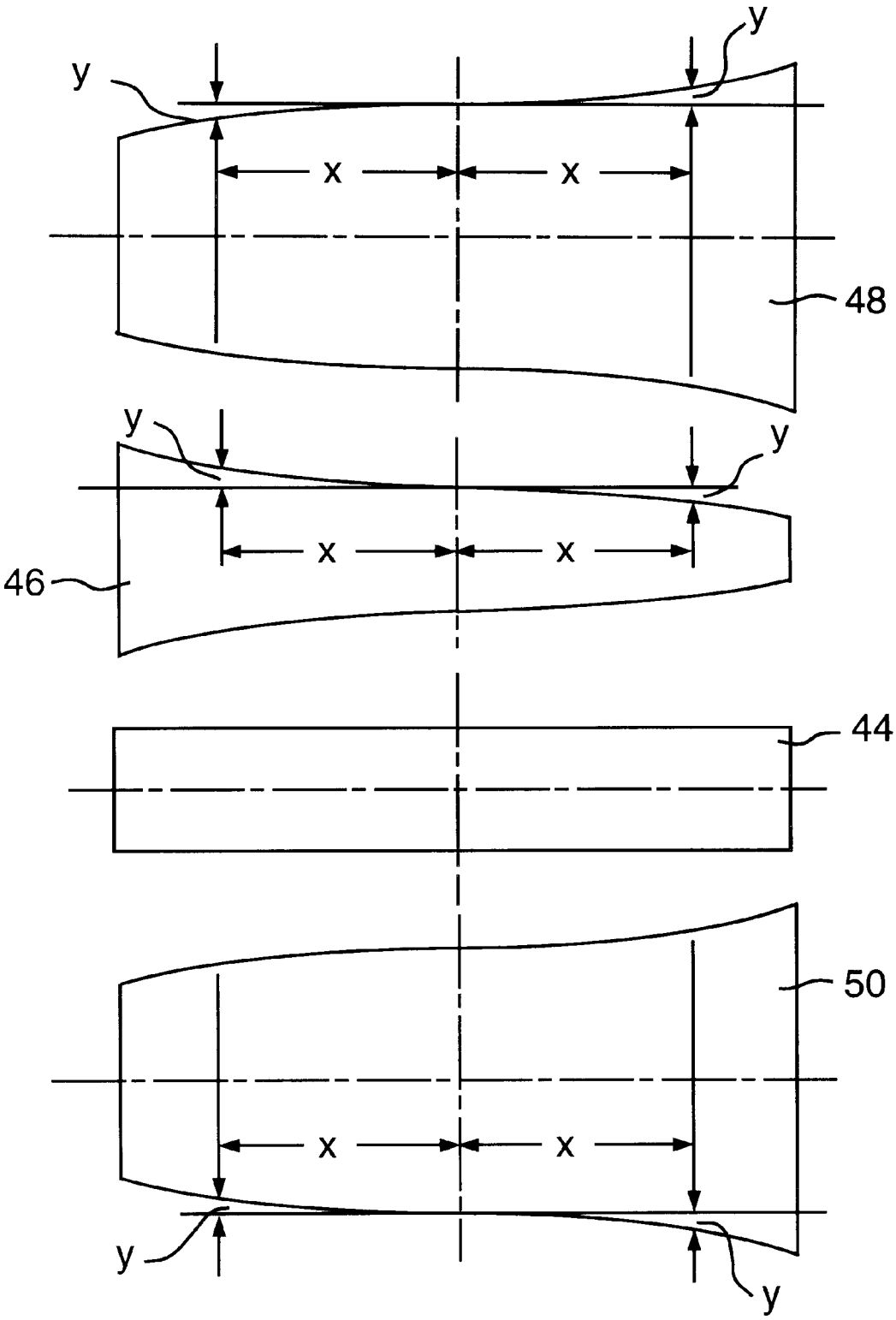
FIG. 6 is a profile form of two backup rolls and two work rolls of the present invention.
Figure 9:
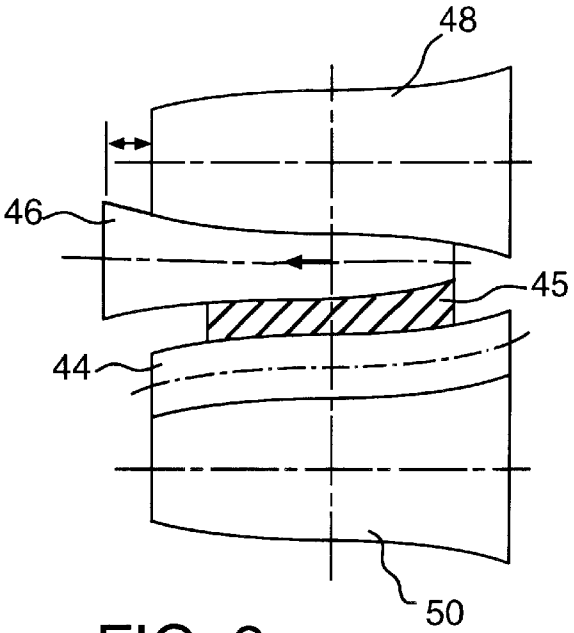
FIG. 9 is a schematic cross-sectional illustration of a 4-hi IVC mill stand of the present invention with the work rolls shifted to produce a strip with a concave profile.
Figure 9A:
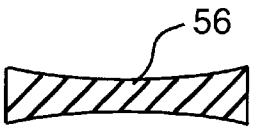
FIG. 9*a* is a strip profile produced by the mill stand of FIG. 9.
Figure 8:
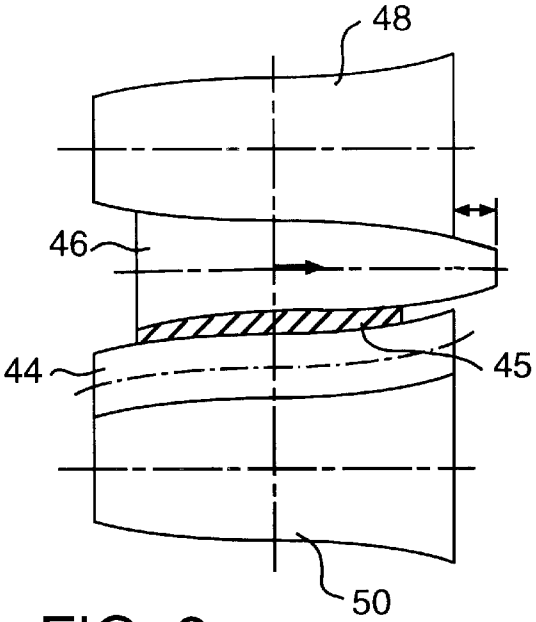
FIG. 8 is a schematic cross-sectional illustration of a 4-hi IVC mill stand of the present invention with the work rolls shifted to produce a strip with a convex profile.
Figure 8A:
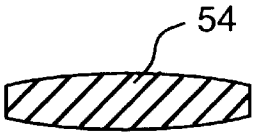
FIG. 8*a* is a strip profile produced by the mill stand of FIG. 8.
Figure 7:
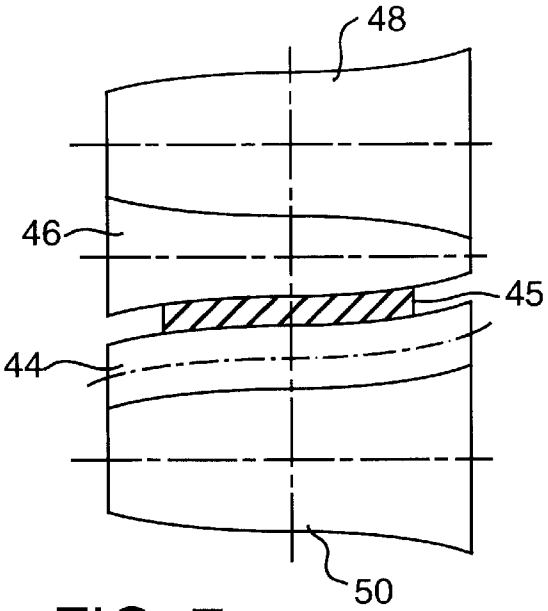
FIG. 7 is a schematic cross-sectional illustration of a 4-hi IVC mill stand of the present invention with the work rolls positioned to produce a generally flat strip.
Figure 7A:
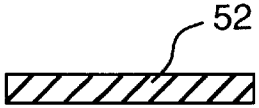
FIG. 7*a* is a strip profile produced by the mill stand of FIG. 7.

The operation of the mill stand of FIG. 6 is shown in FIGS. 7–9. In FIG. 7, cylindrical work roll 44 and IVC work roll 46 are positioned to produce a generally flat strip profile 52, as in FIG. 7*a*, from a metal strip 45. In FIG. 8, IVC work roll 46 is shifted to produce a convex strip profile 54, as in FIG. 8*a* and in FIG. 9, IVC work roll 46 is shifted to produce a concave strip profile 56, as in FIG. 9*a*. In the present invention as shown in FIGS. 6–9, both upper IVC backup roll 48 and lower IVC backup roll 50 and, IVC work roll 46 have an IVC profile, while cylindrical work roll 44 is entirely cylindrical. This allows the obtaining of a variable strip profile by shifting only IVC work roll 46. The cylindrical work roll 46 can be shifted by utilizing a different shifting pattern to reduce local roll wear. In FIGS. 7–9 the IVC rolls are directioned opposite each other.

Figure 10:
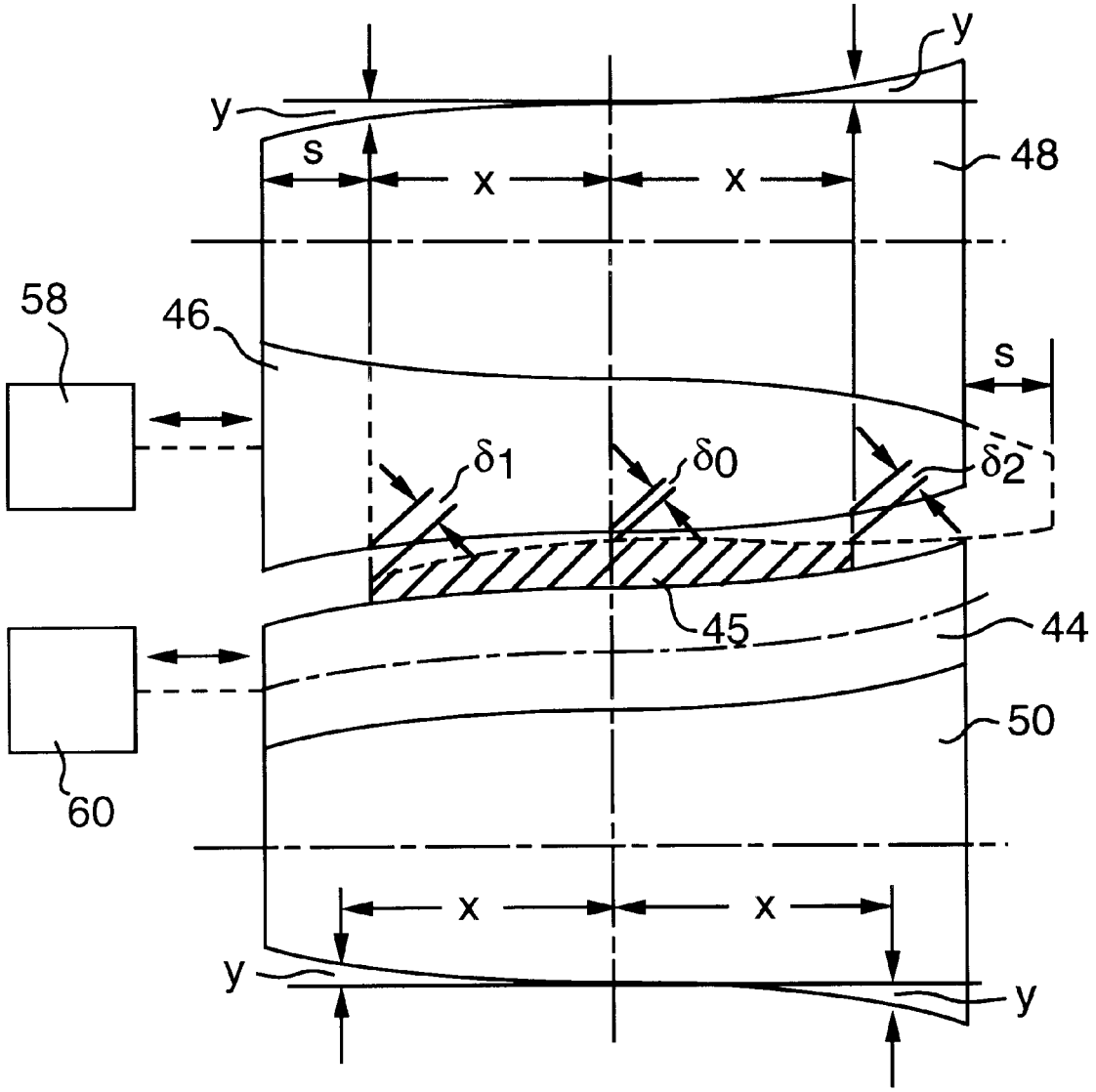
FIG. 10 is a schematic cross-sectional illustration of a 4-hi IVC mill stand of the present invention showing the roll shifting stroke "s"

FIG. 10 is a schematic cross-sectional illustration of the 4-hi IVC mill stand of the present invention showing the roll shifting stroke "s." The 4-hi mill stand of FIG. 10 is the same mill stand as illustrated in FIGS. 6–9, with an upper work roll shift actuator 58 and a lower work roll shift actuator 60 illustrated. Shift actuators 58 and 60 are a means to axially shift the upper work roll 46 and the lower work roll 44, respectively. The other figure numbers correspond to like parts in FIGS. 6–9. When the IVC work roll 46 is shifted a distance "s" a space is created between metal strip 45 and IVC work roll 46. The space, called the change of roll gap, varies in thickness along the length of metal strip 45. The following parameters are illustrated in FIG. 10: $\delta_1$=change of the roll gap at the left roll edge; $\delta_2$=change of the roll gap at the right roll edge; and $\delta_o$=change of the roll gap at the middle of the roll.

Table 1 shows the main parameters of the change of roll gap illustrated in FIG. 10 and their relationship to each other.

TABLE 1

| Parameter | Work roll shifting from left to right | Work roll shifting from right to left |
|---|---|---|
| Change of the roll gap at the left roll edge | $\delta_1 = -2bs(2x - s)$ | $\delta_1 = 2bs(2x - s)$ |
| Change of roll gap at the right roll edge | $\delta_2 = -2bs(2x - s)$ | $\delta_2 = 2bs(2x - s)$ |
| Change of the roll gap in the middle of the roll | $\delta_0 = -2bs^2$ | $\delta_0 = 2bs^2$ |
| Difference between the roll gaps at the left and right sides | $\delta_{12} = -4bs^2$ | $\delta_{12} = -4bs^2$ |
| Equivalent work roll crown | $c_r = -2bs(2x - s)$ | $c_r = 2bs(2x - s)$ |

Figure 11:
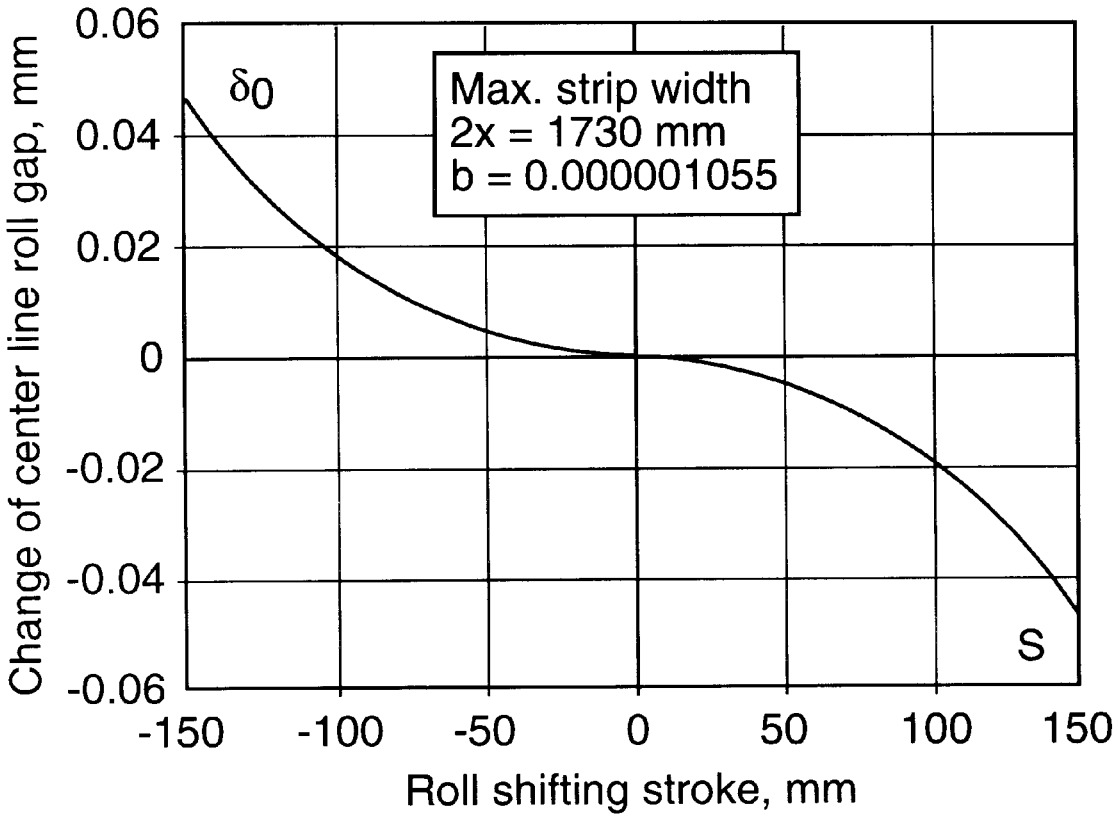
FIG. 11 is a graph of the change of center line roll gap versus the roll shifting stroke of work rolls in a 4-hi IVC mill of the present invention.
Figure 12:
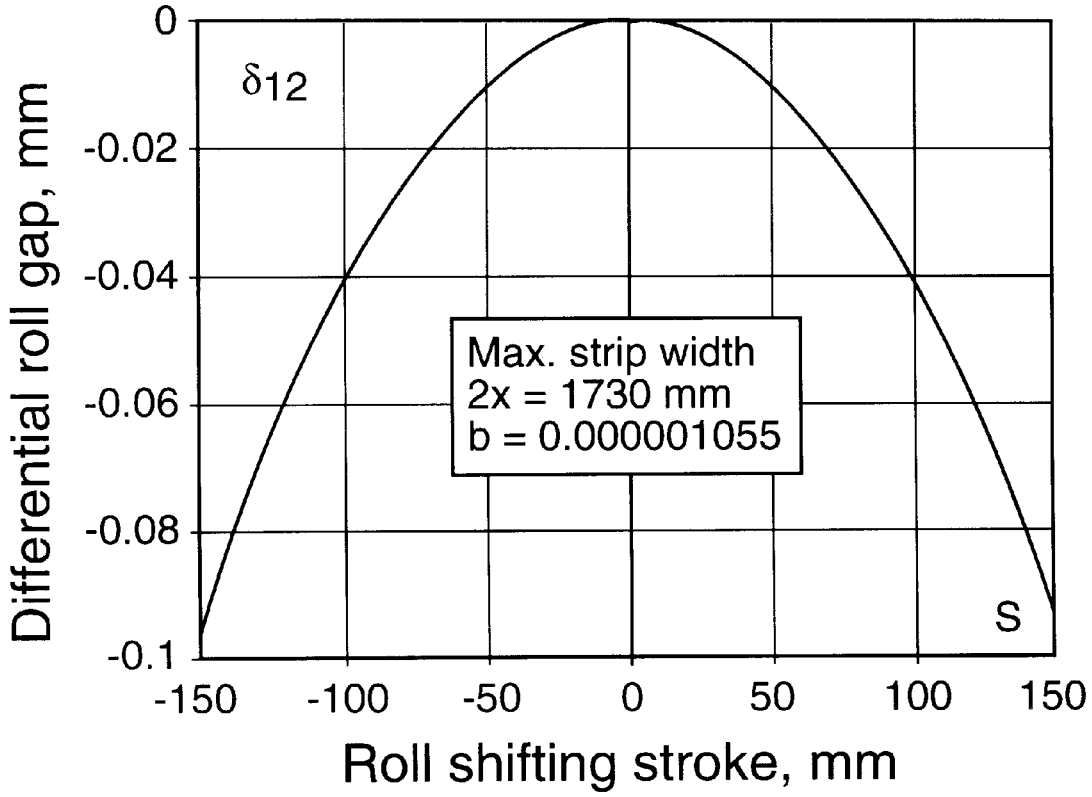
FIG. 12 is a graph of the differential roll gap versus the roll shifting stroke of work rolls in a 4-hi IVC mill of the present invention.
Figure 13:
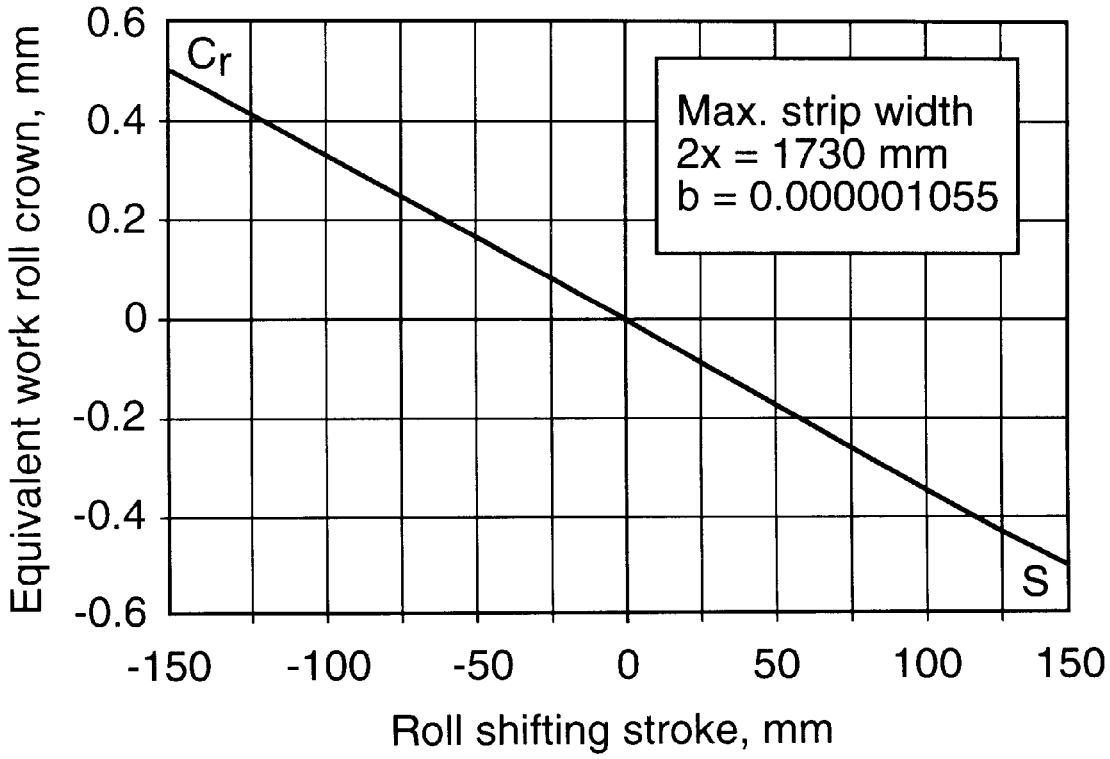
FIG. 13 is a graph of the equivilant work roll crown versus the roll shifting stroke of work rolls in a 4-hi IVC mill of the present invention.

Symbols of Table 1
$\delta_1$ = change of the roll gap at the left roll edge
$\delta_2$ = change of the roll gap at the right roll edge
$\delta_0$ = change of the roll gap at the middle of the roll
$\delta_{12} = \delta_1 - \delta_2$ = difference between the roll gaps at the left and right roll edges
$c_r$ = equivalent work roll crown
s = work roll shifting stroke
x = one half of the roll effective barrel length
y = change of the roll profile
b = polynomial coefficient for the roll profile As seen from Table 1, during shifting the roll gap in the middle of IVC work roll 46 changes by the amount of $\delta_o$. Also, the roll gap becomes slightly asymmetrical due to the differential roll gap $\delta_{12}$. The change in $\delta_o$ over the length of the roll shifting stroke s is shown graphically in FIG. 11, for a maximum strip width of 1730 mm and b=0.000001055. The change in $\delta_o$ is represented by a smooth inversely symmetrical curve from about 0.05 mm to about −0.05 mm for a shifting stroke from −150 mm to 150 mm, respectively. The change in the differential roll gap, $\delta_{12}$, over the length of the roll shifting stroke s is shown graphically in FIG. 12, for a maximum strip width of 1730 mm and b=0.000001055. In comparison, the equivalent work roll crown cr over the length of the roll shifting stroke, s, is shown graphically in FIG. 13, for a maximum strip width of 1730 mm and b=0.000001055. The equivalent work roll crown $c_r$ refers to the shape of the work roll crown necessary to produce the equivalent strip profile with out roll shifting.

For the apparatus and method of the present invention to produce commercial quality metal strip, the variable change of roll gap between metal strip 45 and IVC work roll 46 must be corrected. The apparatus and controls system used for correcting the gaps is illustrated in FIG. 14, which is a schematic cross-sectional illustration of a simplified IVC mill of the present invention with a roll shifting apparatus and the associated controls.

Figure 14:
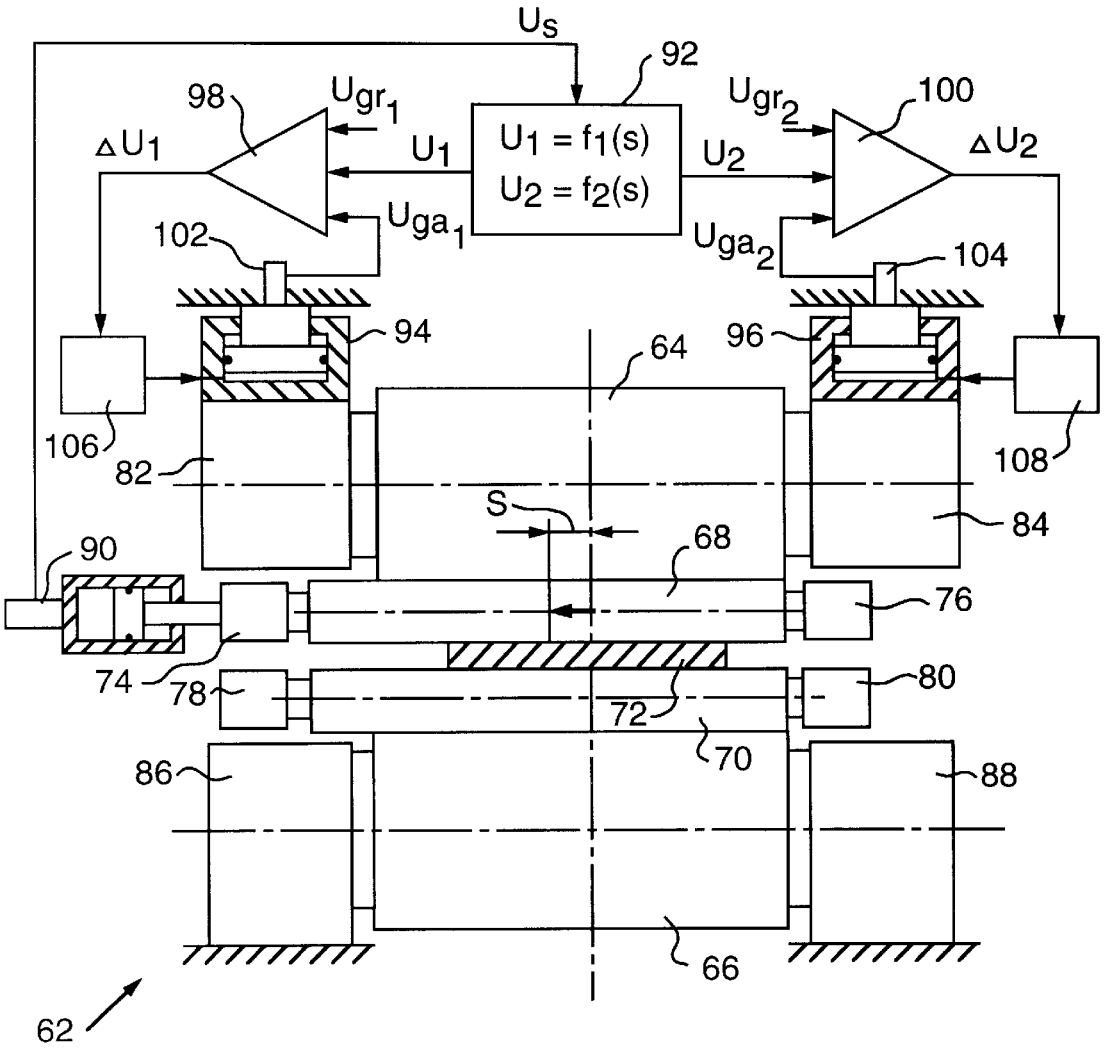
FIG. 14 is a schematic cross-sectional illustration of a simplified IVC mill of the present invention with a roll shifting apparatus and the associated controls.

The apparatus of FIG. 14 is the same mill stand as in FIG. 10, illustrated as a block diagram to show the controller apparatus. A mill stand 62 in FIG. 14 has an upper IVC backup roll 64, a lower IVC backup roll 66, an IVC work roll 68 and a cylindrical work roll 70. Between IVC work roll 68 and cylindrical work roll 70 is a metal strip 72. IVC work roll 68 is journaled in work roll chocks 74 and 76. Cylindrical work roll 70 is journaled in work roll chocks 78 and 80. Upper IVC backup roll 64 is journaled in backup roll chocks 82 and 84 and lower IVC work roll is journaled in backup roll chocks 86 and 88.

The system for shifting IVC work roll 68 and correcting gaps between metal strip 72 and IVC work roll 68 works as follows: The IVC work roll 68 is shifted from a first position to a second position, a distance called the roll shifting stroke s. An output signal $U_s$ from a position transducer 90, which measures the roll shifting stroke s, is generated and subsequently fed into a process controller 92. The process controller 92 calculates two standard reference signals $U_1$ and $U_2$ for adjusting the positions of hydraulic cylinders 94 and 96, respectively, as a function of the roll shifting stroke s. Hydraulic cylinders 94 and 96 are one means for regulating the vertical position of the at least one upper backup roll 64. Other regulating devices like pneumatic or screw type regulating devices are possible. The reference signals $U_1$ and $U_2$ are respectively added by two position regulators 98 and 100 to two actual cylinder position reference signals $U_{gr1}$ and $U_{gr2}$, which measure the actual position of the hydraulic cylinders, respectively, to produce a total signal. The total signals are then compared with two cylinder feedback position signals $U_{ga1}$ and $U_{ga2}$ generated by two cylinder position transducers 102 and 104. The signals are compared in the two position regulators 98 and 100. Two output error signals $\Delta U_1$ and $\Delta U_2$ are generated by the comparison of the two total signals with two cylinder feedback position signals $U_{ga1}$ and $U_{ga2}$. The two output error signals $\Delta U_1$ and $\Delta U_2$ are differential signals because they represent the difference between the total signals and two cylinder feedback position signals $U_{ga1}$ and $U_{ga2}$. The two output error signals $\Delta U_1$ and $\Delta U_2$ generated are output from the position regulators 98 and 100 to two servovalves 106 and 108. Servovalves 106 and 108 control fluid flow in and out of the hydraulic cylinders 94 and 96, respectively, thereby regulating and adjusting the position of the upper IVC backup roll 64 and the IVC work roll 68.

Figure 15:
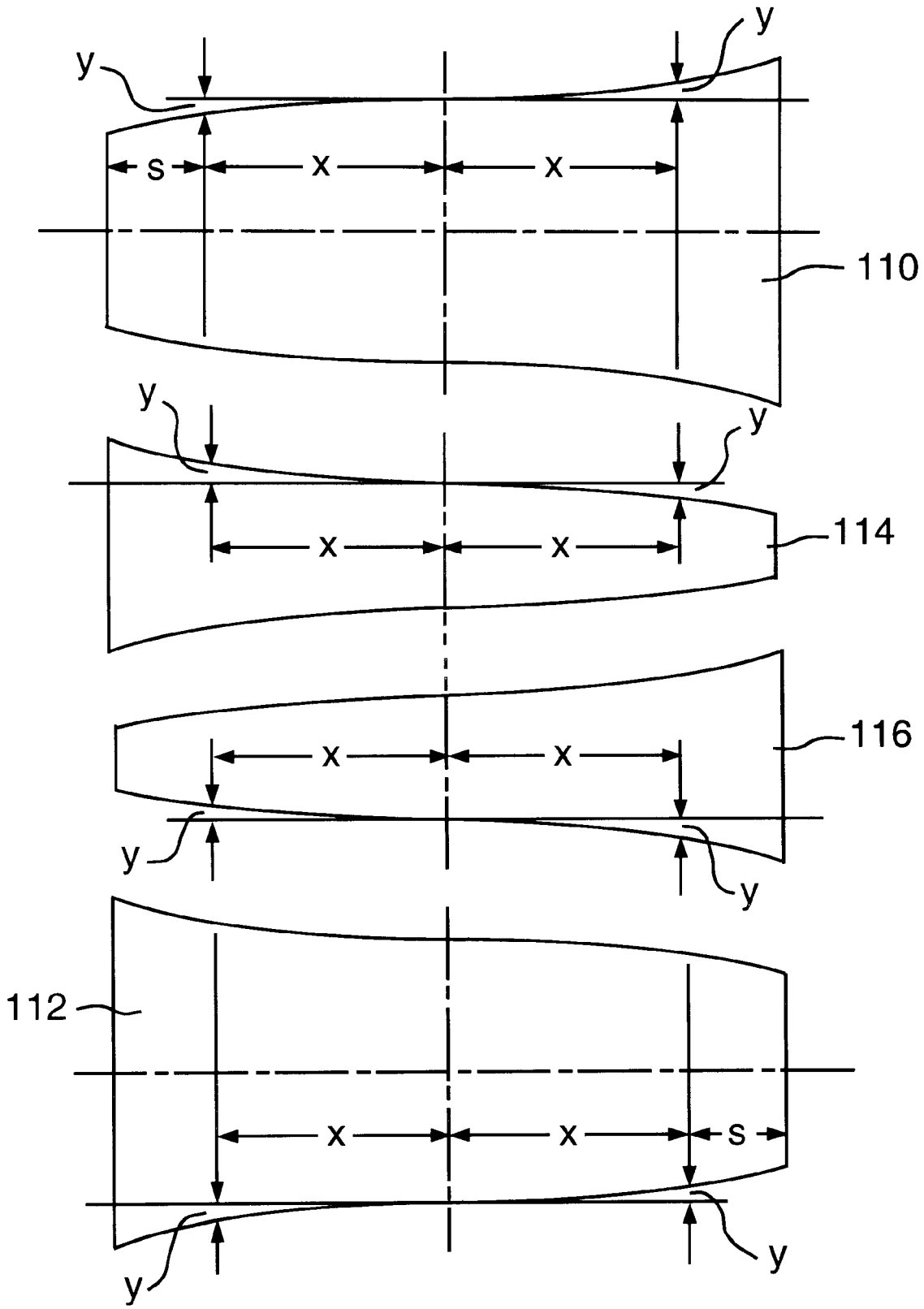
FIG. 15 is a profile form of two backup rolls and two work rolls of another embodiment of the present invention.

In another embodiment of the present invention, the cylindrical work roll of FIG. 6 is replaced with an IVC work roll. FIG. 15 shows a 4-hi mill stand of the present invention having an upper IVC backup roll 110 and a lower IVC backup roll 112 and an upper IVC work roll 114 and a lower IVC backup roll 116. The general IVC mill of FIG. 15 is not limited to the 4-hi type and can have more than one upper or lower backup roll or intermediate rolls (not shown). The apparatus also has a housing (not shown) for mounting the rolls and a means for shifting the rolls. Each roll is inversely symmetrical because at a distance X from the center of the roll, indicated by the center line, the vertical deviation from the center where X=0 is equal to Y on both the left and right sides of the roll.

Figure 16:
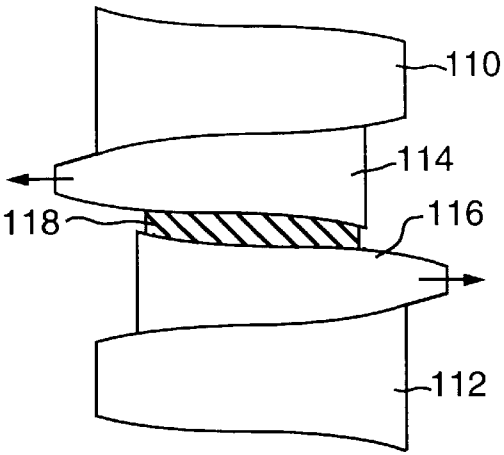
FIG. 16 is a schematic cross-sectional illustration of a 4-hi IVC mill stand of the present invention with the work rolls having perfect contact with their associated back-up rolls and shifted to produce a strip with a convex profile.
Figure 16A:
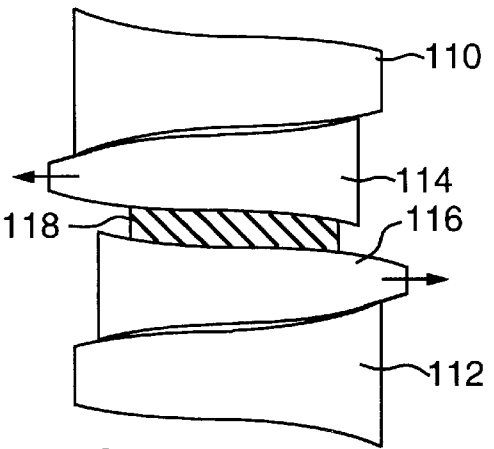
FIG. 16*a* is a schematic cross-sectional illustration of the mill stand of FIG. 16 with interface mismatch.
Figure 17:
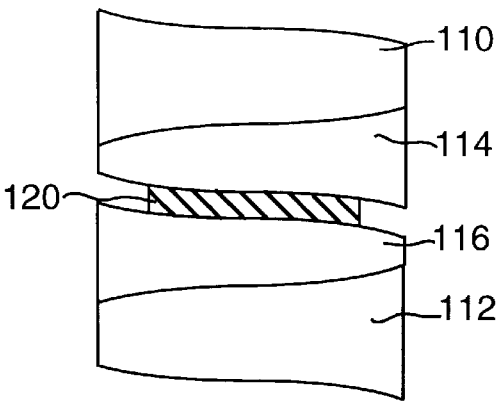
FIG. 17 is a schematic cross-sectional illustration of a 4-hi IVC mill stand of the present invention with the work rolls having perfect contact with their associated back-up roll and positioned to produce a generally flat strip.
Figure 17A:
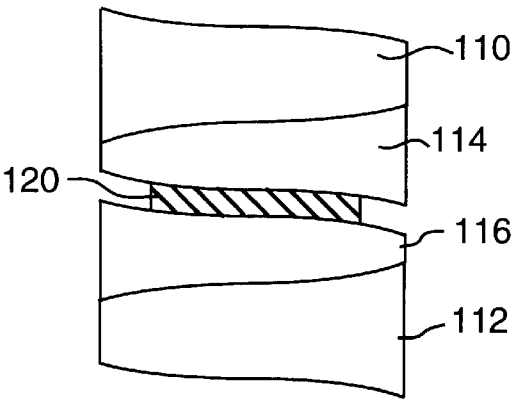
FIG. 17*a* is a schematic cross-sectional illustration of the mill stand of FIG. 17.
Figure 18:
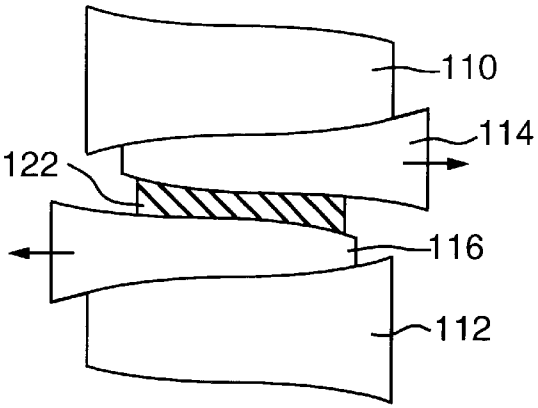
FIG. 18 is a schematic cross-sectional illustration of a 4-hi IVC mill stand of the present invention with the work rolls having perfect contact with their associated back-up roll and shifted to produce a strip with a concave profile.
Figure 18A:
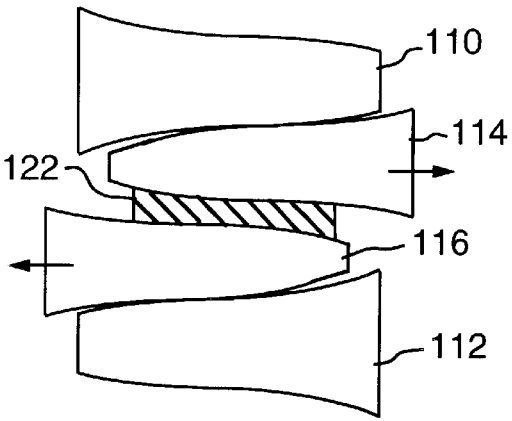
FIG. 18*a* is a schematic cross-sectional illustration of the mill stand of FIG. 18 with interface mismatch.

The main roll shifting patterns for the 4-hi mill stand of FIG. 15 are shown in FIGS. 16–18. FIG. 16 is a schematic cross-sectional illustration of a 4-hi IVC mill stand of the present invention with the upper IVC work roll 114 and the lower IVC work roll 116 having perfect contact with associated back-up rolls and shifted to produce a convex strip profile on metal strip 118. FIG. 16*a* is a schematic cross-sectional illustration of the mill stand of FIG. 16 with interface mismatch (roll force not applied). FIG. 17 is a schematic cross-sectional illustration of a 4-hi IVC mill stand of the present invention with the upper IVC work roll 114 and the lower IVC work roll 116 having perfect contact with associated back-up rolls and positioned to produce a generally flat strip profile on metal strip 120. FIG. 17*a* is a schematic cross-sectional illustration of the mill stand of FIG. 17. FIG. 18 is a schematic cross-sectional illustration of a 4-hi IVC mill stand of the present invention with the upper IVC work roll 114 and the lower IVC work roll 116 having perfect contact with associated back-up rolls and shifted to produce a concave strip profile on metal strip 122. FIG. 18*a* is a schematic cross-sectional illustration of the mill stand of FIG. 18 with interface mismatch.

In FIGS. 15–18 the top and bottom rolls are ground to an inverse symmetrical shape. Both sets of work and backup rolls are ground identically but the shaping of the top rolls is offset by 180° to that of the bottom rolls, so that they complement each other to form a symmetrical roll gap contour. In other words the rolls are facing opposite directions.

The roll profile of the IVC rolls in FIG. 15 is mathematically represented by two polynomial functions having a second and/or forth order terms. Each polynomial function represents the profile along one half of the length of the roll, where the roll length is also referred to as the roll barrel length. The two functions have their origin at the roll barrel center with one function having an upward concavity, while the other having a downward concavity. In this system, the work rolls can be shifted a distance of s in the horizontal direction using a bi-directional shifting mechanism, as illustrated in FIGS. 16–18 to reduce the local wear and provide a variable profile.

Figure 21:
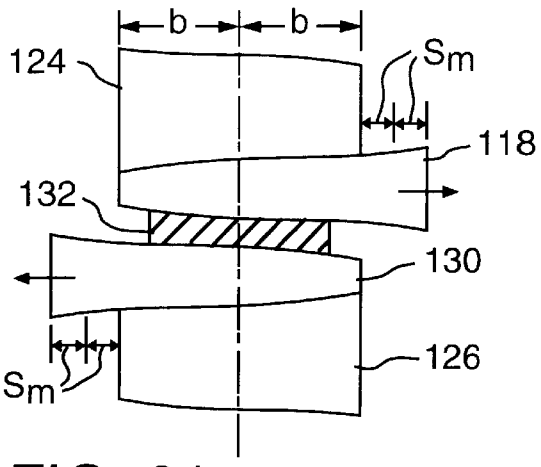
FIG. 21 is a schematic cross-sectional illustration of a 4-hi IVC mill stand of the present invention with the work rolls shifted to produce a strip with a concave profile.
Figure 20:
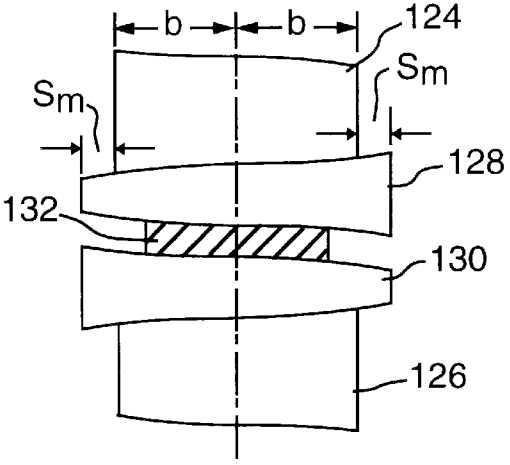
FIG. 20 is a schematic cross-sectional illustration of a 4-hi IVC mill stand of the present invention with the work rolls positioned to produce a generally flat strip.
Figure 19:
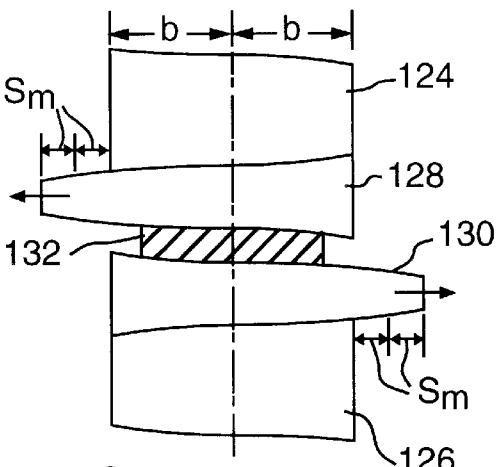
FIG. 19 is a schematic cross-sectional illustration of a 4-hi IVC mill stand of the present invention with the work rolls shifted to produce a strip with a convex profile.
Figure 21A:
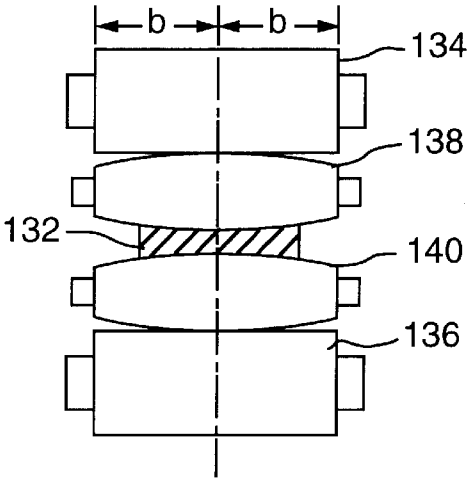
FIG. 21a Prior Art
FIG. 21*a* is a schematic cross-sectional illustration of a prior art conventional mill stand showing the comparative work rolls necessary to produce a strip with a concave profile comparative to that of FIG. 21.
Figure 20A:
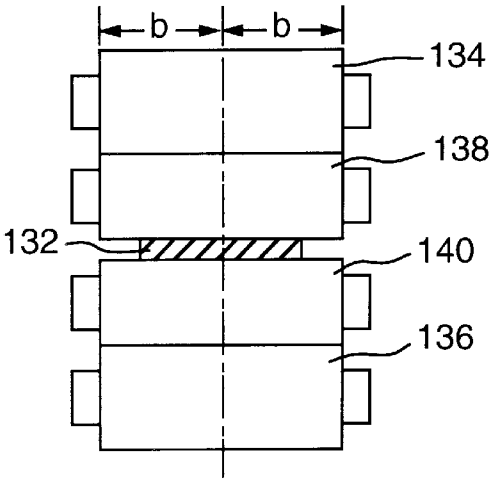
FIG. 20a Prior Art
FIG. 20*a* is a schematic cross-sectional illustration of a prior art conventional mill stand showing the comparative work rolls necessary to produce a generally flat strip comparative to that of FIG. 20.
Figure 19A:
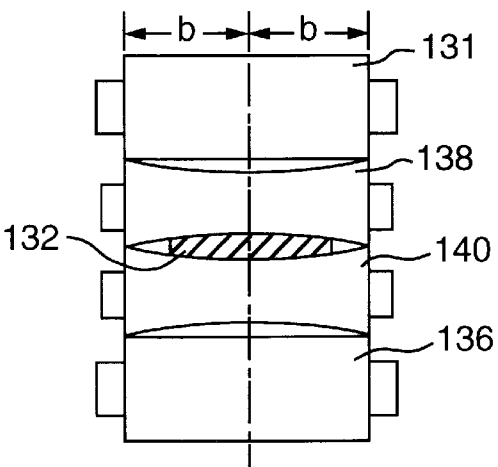
FIG. 19a Prior Art
FIG. 19*a* is a schematic cross-sectional illustration of a prior art conventional mill stand showing the comparative work rolls necessary to produce a strip with a convex profile comparative to that of FIG. 19.

FIGS. 19–21 show three typical examples of the relation between the shifting positions of the IVC roll and the equivalent work roll crown for a 4-hi IVC mill of the present invention with 4 IVC rolls having perfect contact with associated back-up rolls. The examples are:

1. Negative Crown: this crown occurs when the IVC work rolls are shifted inwards against the IVC backup rolls (FIG. 19);
2. Zero Shift Crown: this is the crown that occurs when there is no axial shifting (FIG. 20); and
3. Positive Crown: this crown occurs when the IVC work rolls are shifted outwards against the IVC backup rolls (FIG. 21).

In each of FIGS. 19–21, the mill stand has two IVC backup rolls 124 and 126 and two IVC work rolls 128 and 130. The strip profile (negative crown) on metal strip 132 generated by the shifting of the work rolls 128 and 130 can be reproduced using a 4-hi mill, shown in FIGS. 19*a* to 21a respectively, with cylindrical backup rolls 134 and 136 and with work rolls 138 and 140 ground to the equivalent crown produced by the shifting of IVC work rolls 128 and 130 of the 4-hi IVC mill. To compare the mills of FIGS. 19–21 with the equivalent mills in FIGS. 19*a* to 21*a*, a dashed center line traverses through the centers of all of the backup rolls of the mills, with "b" indicating one half of a roll barrel length. $S_m$ is the maximum work roll shifting stroke.

Figure 22:
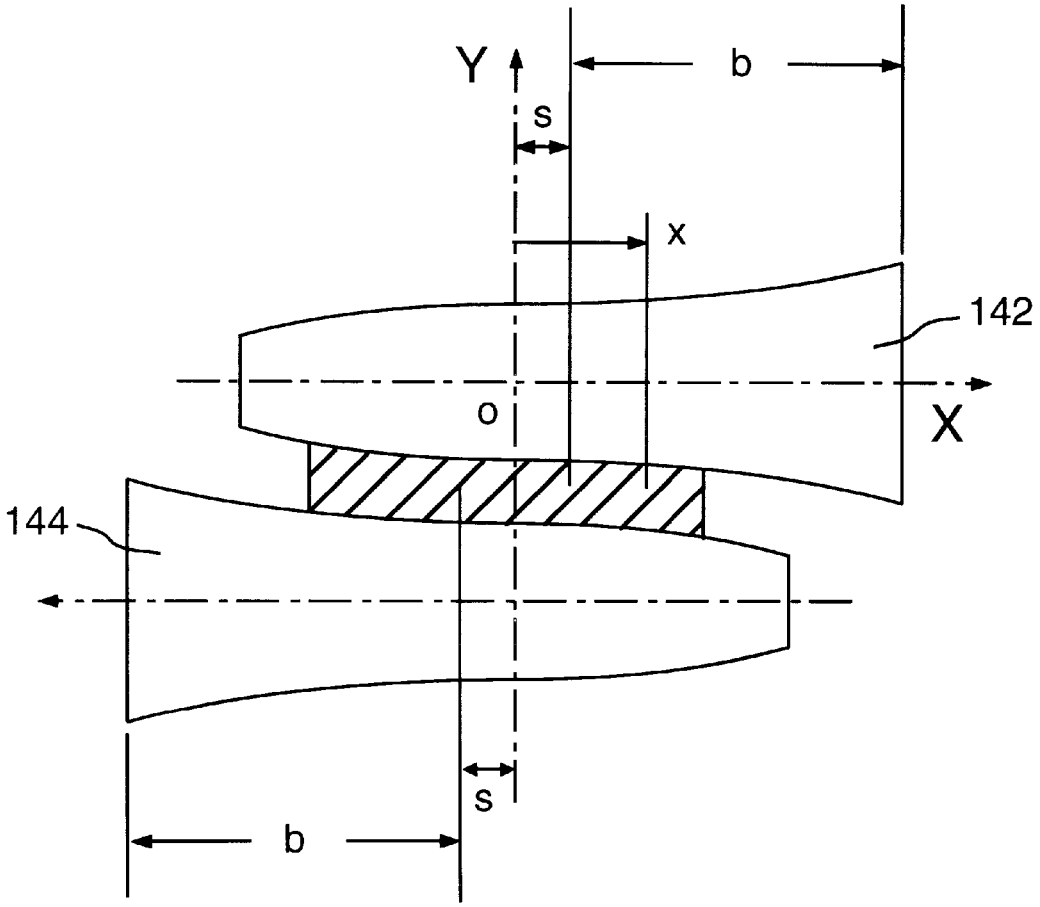
FIG. 22 is a profile form of two work rolls of the present invention.

Referring to FIG. 22, the mathematical derivation of the IVC profile of upper IVC roll 142 and lower IVC roll 144 is as follows:

The upper IVC roll 142 and the lower IVC roll 144 is represented by two functions each having a parabolic (FIG. 1*b*) and/or quartic (FIG. 1*d*) polynomial part. The two functions are connected smoothly at the work roll center (x=0), indicated by the solid line in FIG. 22. One function results in an upward concavity, while the other results in a downward concavity. FIG. 22 shows the upper IVC roll 142 and the lower IVC roll 144 in the shifted position.

The IVC roll profile, y, is expressed as follows:

For Upward Concavity $$y=a_1x^4+a_2x^2$$

For Downward Concavity $$y=-a_1x^4-a_2x^2$$

Where, $a_1$=coefficient for the $4^{th}$ order polynomial term $a_2$=coefficient for the $2^{nd}$ order polynomial term x=distance from roll center The coefficients $a_1$ and $a_2$ are calculated as follows in equations (8) and (9):

$$a_1 = \frac{nC_{ecm}}{4s_m(n+1)[4b(b^2+s_m^2)-s_m^3]} \tag{8}$$

$$a_2 = \frac{C_{ecm}}{4s_m(n+1)(2b-s_m)} \tag{9}$$

where,

| | | |
|---|---|---|
| $s_m$ | = | maximum work roll shifting stroke |
| $C_{ecm}$ | = | maximum equivalent work roll crown for maximum shifting stroke |
| $n$ | = | distribution factor between quadratic and quartic component of roll profile |
| $b$ | = | half of the roll body length |

When n=0, $a_1$=0 and the roll profile is defined by quadratic component only. When n=∞, $a_2$=0 and the roll profile is defined by quartic component only.

The equivalent work roll profile, like that in FIGS. 19*a*–21*a*, $C_e$ corresponding to the shifting stroke "s" is:

1) For $s_m \leqq x \leqq b$ $$C_e=c_1x^1+c_2x+c_3 \tag{10}$$

where, $$c_1=16a_1s \quad c_2=8s(2a_1s^2+a_2) \quad c_3=-4s^2(a_1s^2+a_2)$$

2) For $0 \leqq x \leqq s_m$ $$C_e=d_1x^4+d_2x^2 \tag{11}$$

where, $$d_1=4a_1 \quad d_2=4(6a_1s^2+a_2)$$

Figure 23:
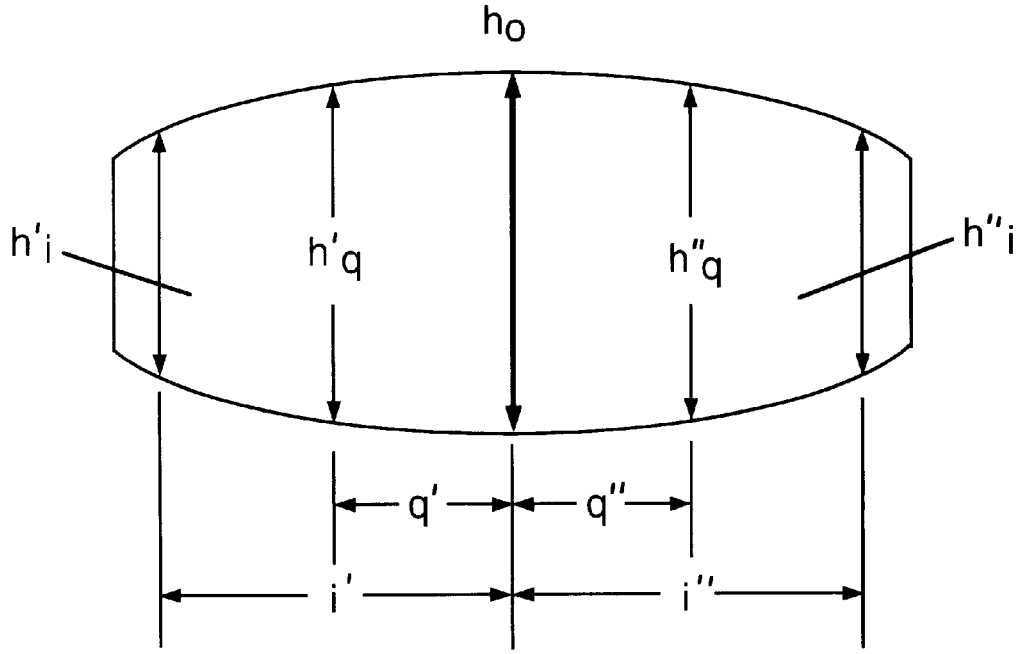
FIG. 23 is a strip profile of a centrally crowned strip.
Figure 24:
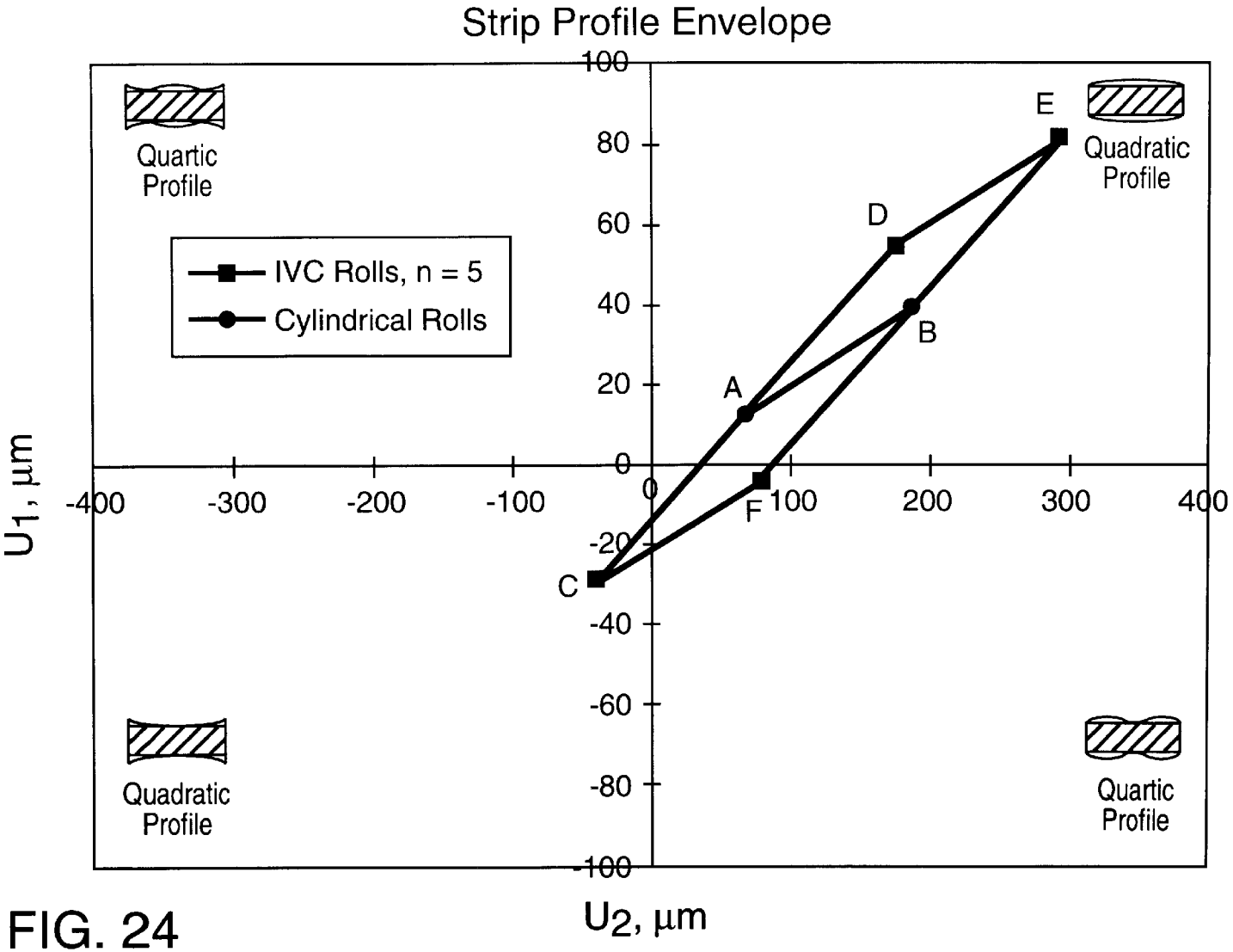
FIG. 24 is a quadrant graph of of the strip profile envelope for a 4-hi IVC mill and a 4-hi mill with cylindrical rolls.

The strip profile envelope, as illustrated in FIG. 24, is calculated using the parameters $U_1$ and $U_2$ defined as follows in equations (12) and (13):

$$U_1 = h_o - \frac{h'_q + h''_q}{2} \quad (12)$$

$$U_2 = h_o - \frac{h'_i + h''_i}{2} \quad (13)$$

where the following parameters are illustrated in FIG. 23, $h_o$ = strip thickness at center,
$h'_q, h''_q$ = strip thickness at mid points $q'$ and $q''$,
$h'_i, h''_i$ = strip thickness at points $i'$ and $i''$,
strip thickness at points $i'$ and $i''$,
($i'$ & $i''$ are assumed to be
25.4 mm from strip edge Parameters $U_1$ and $U_2$ define the area of the strip profile envelope. Different strip profiles have different total areas. The strip profile envelope is the family or group of strip profiles possible on a rolling apparatus.

Using an IVC mill of the present invention, a family of strip profiles created prior to shifting are strip profiles expressed by polynomial functions having terms of the $n^{th}$ order, where n is preferably 1–5 inclusive, and the family of strip profiles produced by shifting at least one upper roll having an inverse symmetrical profile and at least one lower roll having an inverse symmetrical profile are strip profiles expressed by polynomial functions having terms of the $(n-1)^{th}$ order, where n is preferably 1–5, inclusive.

To further show the advantages the IVC mill of the present invention, a working example was developed with the following parameters:

4-hi mill with IVC work and IVC backup rolls

Work roll diameter=584 mm

Backup roll diameter=1422 mm

Work roll barrel length=1976 mm

Backup roll barrel length=1676 mm

Strip width=1232 mm

Strip entry thickness=1.575 mm

Strip exit thickness=0.975 mm

Rolling force=1378 tons

Work roll bending force,BF=±80 metric tons

Work roll shifting stroke, s=±150 mm (IVC work rolls only)

FIG. 24 is a quadrant graph showing a plot of the strip profile envelope for two 4-hi mills, one mill with all cylindrical rolls and another mill with all IVC rolls, as defined above, with the distribution factor, n, on the IVC rolls having a value of 5. The points on the graph correspond to the following work roll bending force (BF) and shifting stroke (s):

| Point | Bending Force, BF (tons) | Shifting Stroke, s (mm) |
|---|---|---|
| A | 80 | 0 |
| B | −80 | 0 |
| C | 80 | 150 |
| D | 80 | −150 |
| E | −80 | −150 |
| F | −80 | 150 |

Polygon CDEF represents the strip profile envelope possible for the 4-hi IVC mill of the present invention, described above with work roll bending and shifting applied. The polygon CDEF is an area created by plotting the parameters $U_1$ and $U_2$ for the strip profiles. The larger the polygon on the quadrant graph of FIG. 24, the larger the strip profile envelope that can be created and the larger the number of various strip profiles that can be corrected on the mill. In the FIG. 24, the smaller the value of n the larger the area of the polygon and the larger the value of n the smaller the area of the polygon. The larger the value of n, the more quartic the strip profile. By comparison, line AB in FIG. 24 represents a 4-hi mill with all cylindrical rolls. This line shows graphically that only a limited range of quadratic strip profiles can be created. The profiles are all quadratic and vary only by the roll bending force.

IVC rolls with applied bending provides a wide range of strip crown control represented by the area of polygon CDEF. Because of the shape of the IVC rolls, a variety of combinations of shifting strokes and bending forces result in a wide range of strip crown control. Each side of the polygon corresponds to either positive/negative work roll shifting or positive/negative work roll bending. Using cylindrical rolls with roll bending provides a limited control of strip crown that varies only along a straight line.

Figure 25:
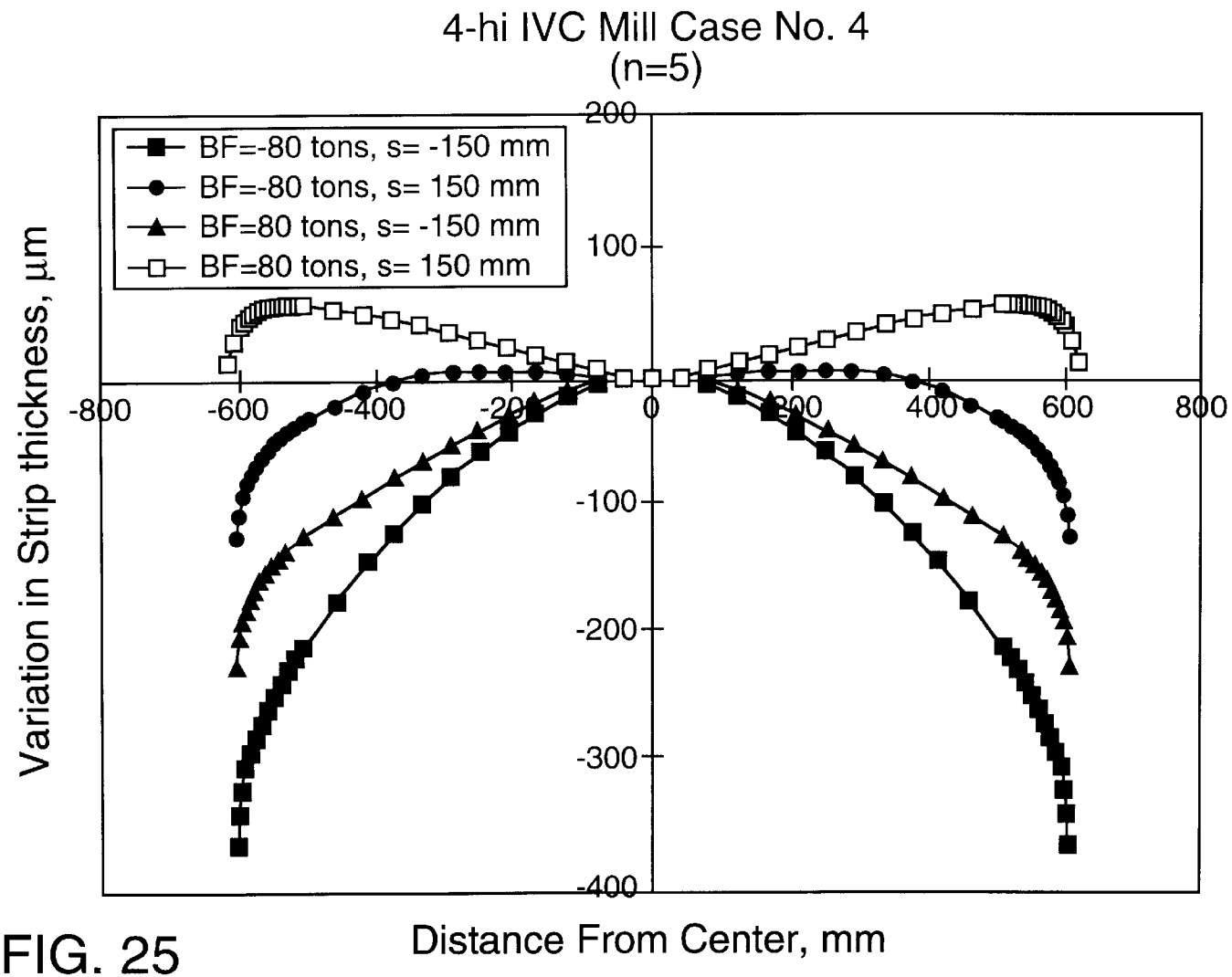
FIG. 25 is a graph of the variation in strip thickness versus the distance from the work roll center of a 4-hi IVC mill stand of the present invention.

FIG. 25 is a graph of the variation in strip thickness versus distance from the work roll center of a 4-hi IVC mill stand of the present invention, as described by the parameters above, under bending force and roll shift. In this example n=5 and the strip thickness or the strip profiles were calculated by employing the 3-dimensional finite element method. Bending force applied to the top work roll creates a quadratic correction because the force will bend the metal strip in a parabolic shape. A positive work roll shift of 150 mm, as shown in FIGS. 18 and 18*a*, results in a positive crown control, meaning that a concave strip profile will result. In FIG. 25 the graphed line with the open squares illustrates the combined effect of bending force of 80 tons and positive roll shift of 150 mm. The metal strip exhibits a slight increase in thickness at the edges as compared with the center of the strip. This is to be expected as positive crown control creates a concave strip profile. The effect of roll shift is greater than the effect of bending force because of the slight edge crown.

At a bending force of 80 tons with negative crown control, a work roll shift of the rolls toward each other of 150 mm as in FIGS. 16 and 16*a*, the metal strip will have a center crown as indicated by the graphed line with the solid triangles. The crown is not as steep as the case represented by graphed line of solid squares where a bending force of negative 80 tons is applied.

Figure 26:
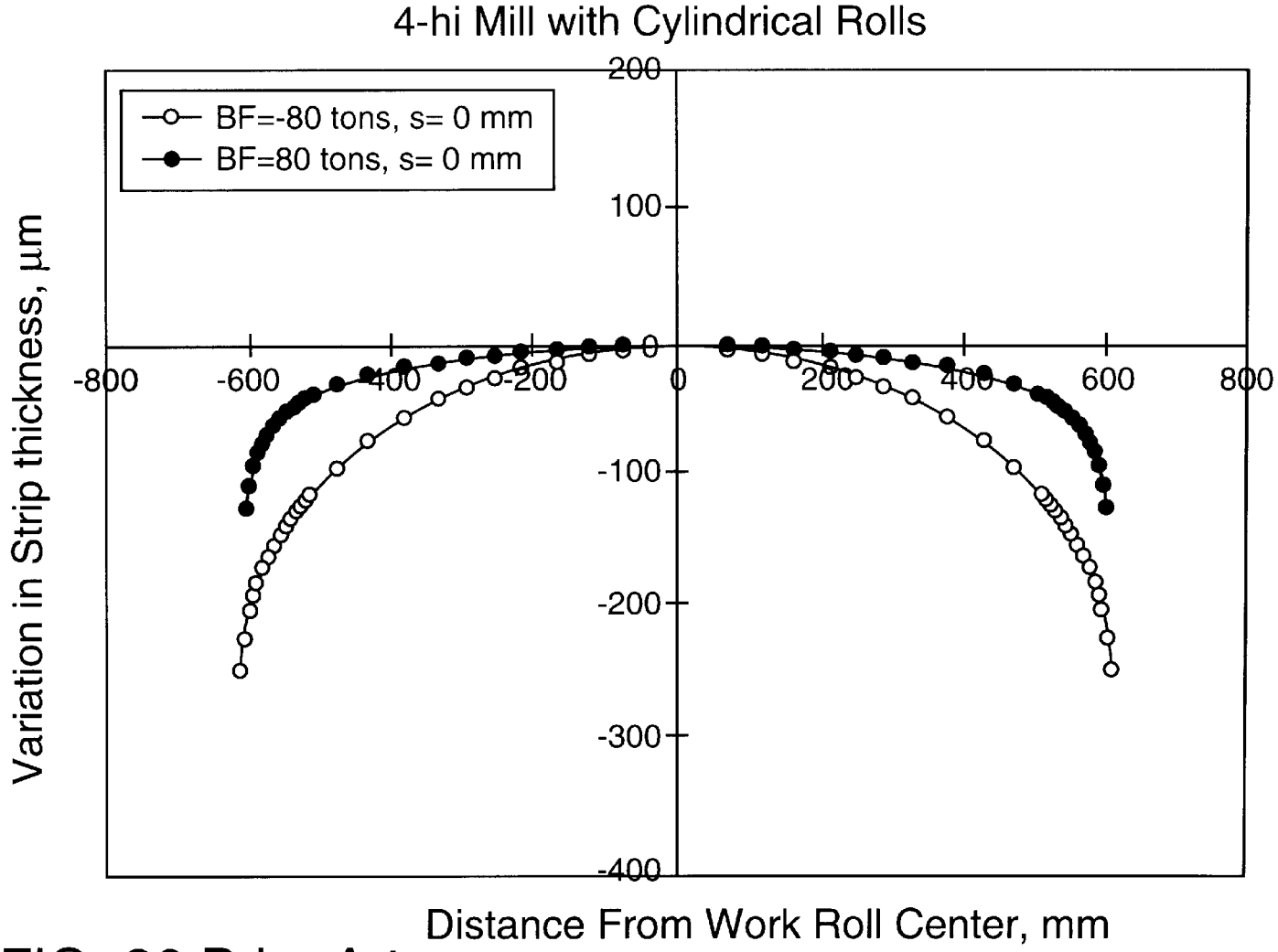
FIG. 26 Prior Art
FIG. 26 is a graph of the variation in strip thickness versus the distance from the work roll center of a prior art 4-hi mill stand with cylindrical rolls.

FIG. 26 is a graph of the variation in strip thickness versus distance from the work roll center of a 4-hi mill stand with cylindrical rolls. Because cylindrical rolls are not shifted, the graph shows the effects of bending force without roll shifting. As expected, a convex strip profile is produced. A steeper crown results from a bending force of negative 80 tons as opposed to positive 80 tons, as indicated by the difference in curvature of the open circle and solid circle graphed lines.

Figure 27:
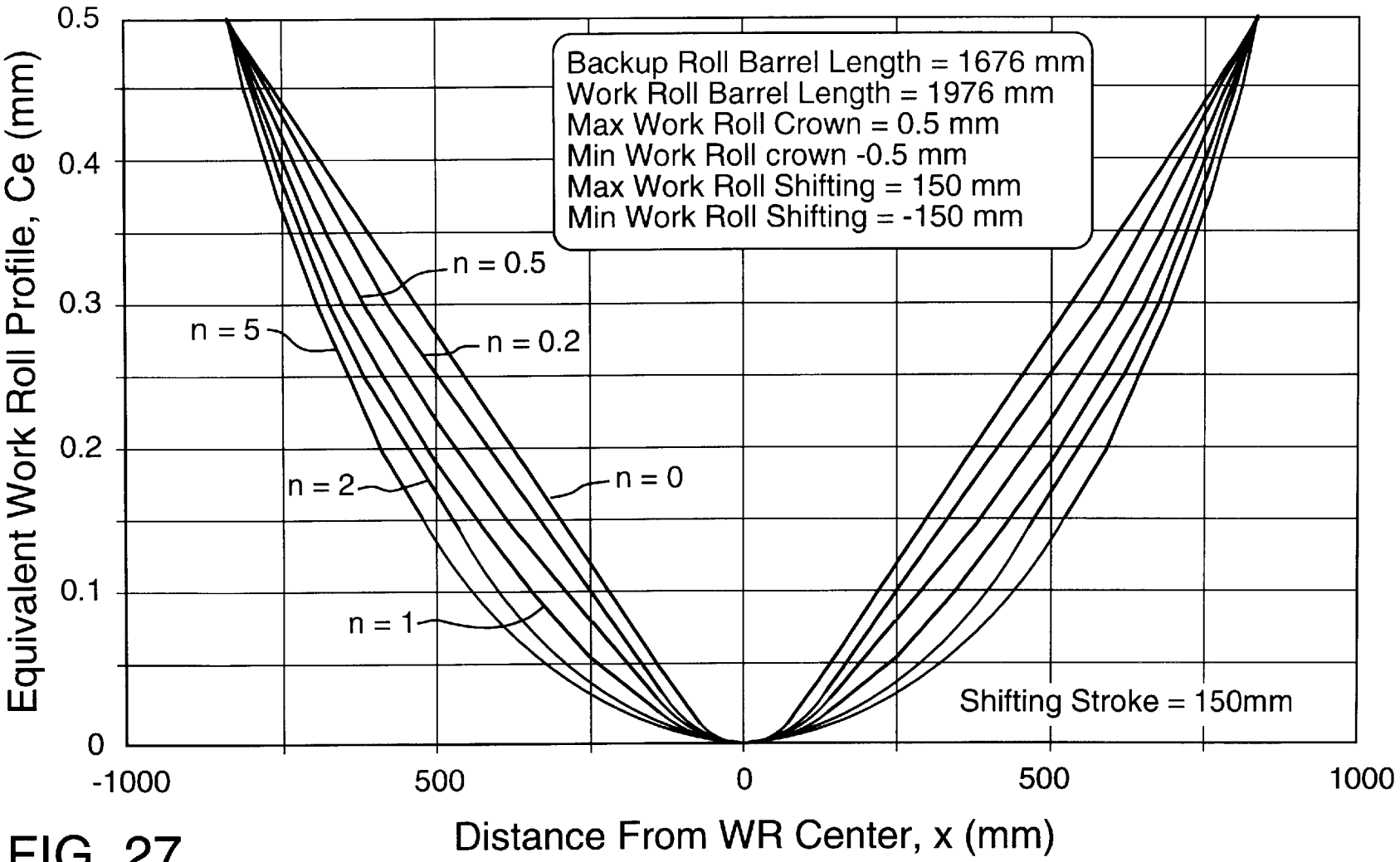
FIG. 27 is a graph of the equivalent work roll profile for positive work roll shifting versus the distance from work roll center of a 4-hi IVC mill stand of the present invention.
Figure 28:
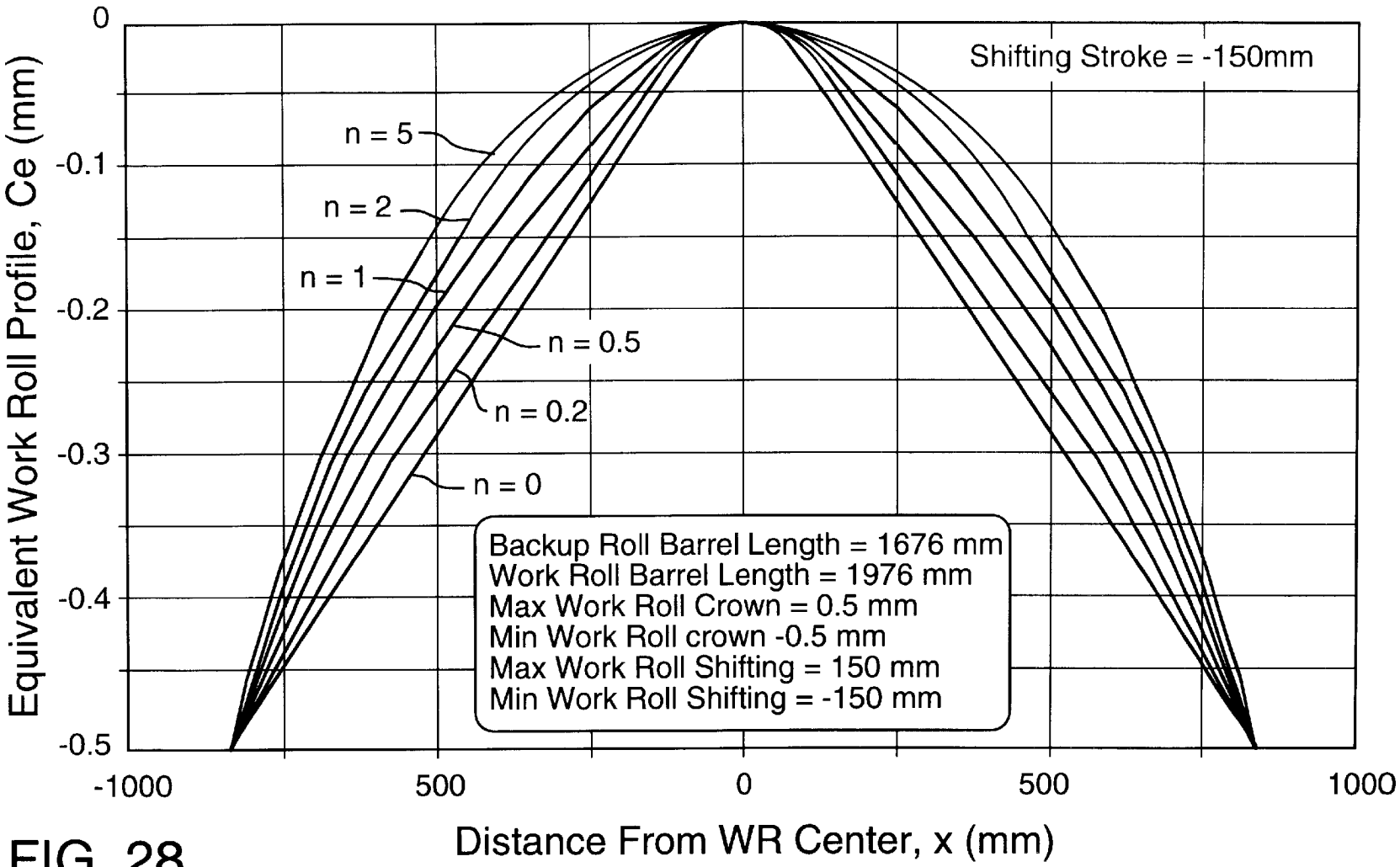
FIG. 28 is a graph of the equivalent work roll profile for negative work roll shifting versus the distance from the work roll center of a 4-hi IVC mill stand of the present invention.
Figure 29:
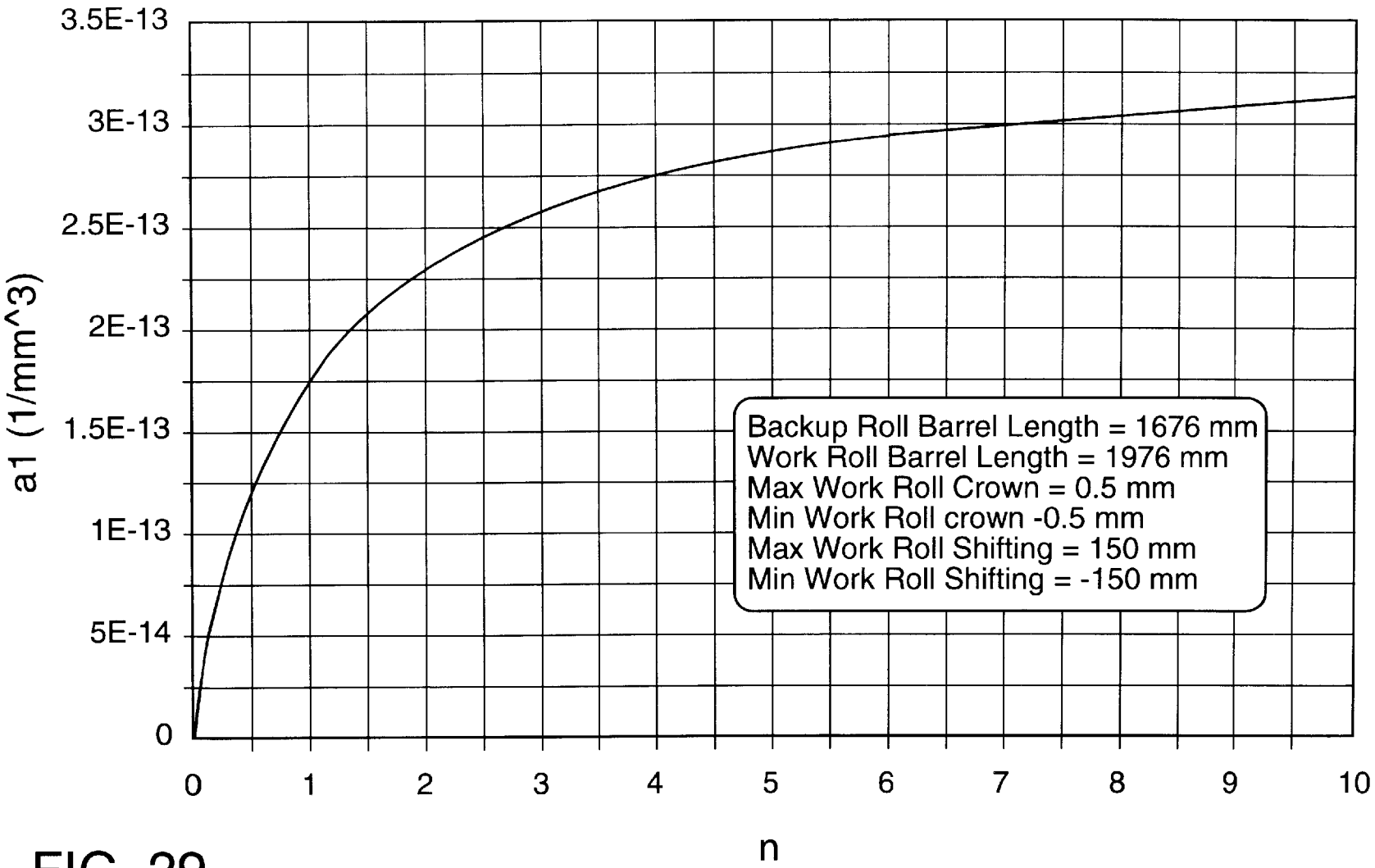
FIG. 29 is a graph of al versus n in a 4-hi IVC mill stand of the present invention.
Figure 30:
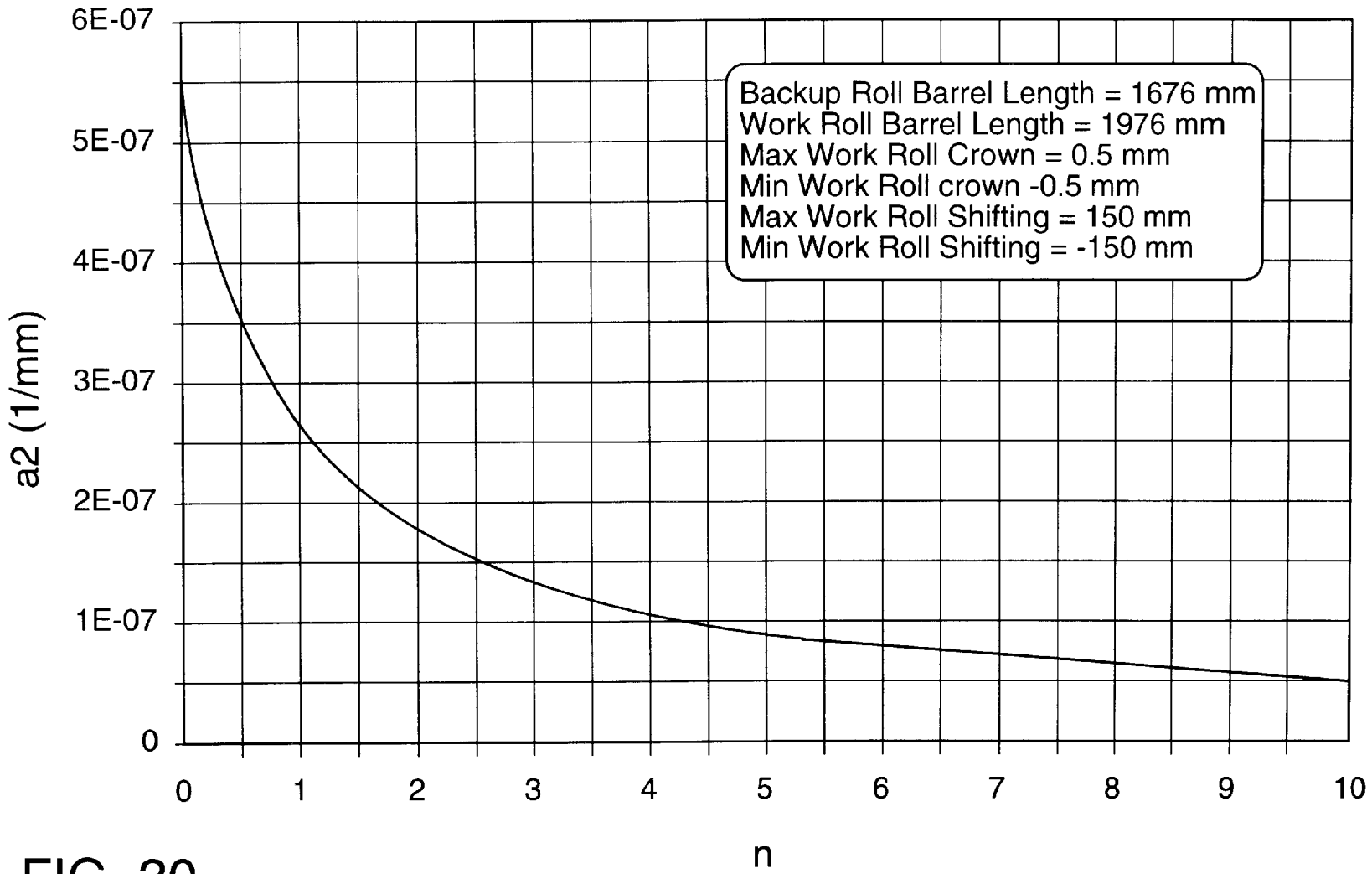
FIG. 30 is a graph of a2 versus distribution factor n in a 4-hi IVC mill stand of the present invention.
Figure 31:
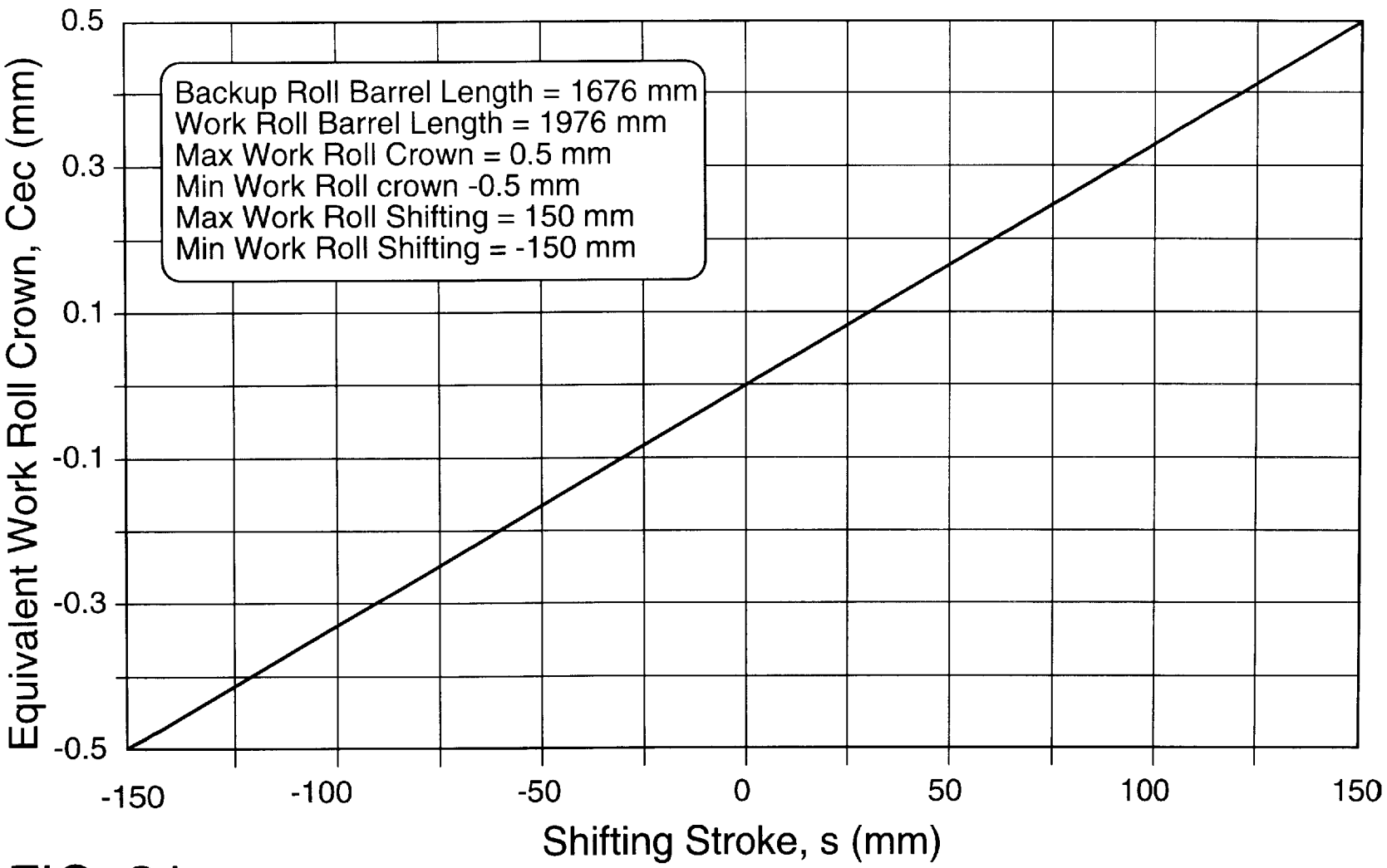
FIG. 31 is a graph of the equivalent work roll crown versus work roll shifting stroke in a 4-hi IVC mill stand of the present invention.

Again, referring to the IVC mill of the present invention as defined by the parameters above, FIG. 27 shows the equivalent work roll profile as function of the parameter n for a positive work roll shifting stroke of 150 mm, and FIG. 28 shows the equivilant profile for a negative shifting stroke of 150 mm. If n=0, then $a_1$=0 and the IVC rolls have an inverse parabolic profile that results in an equivalent triangular roll profile during shifting. If $0<n<\infty$, the IVC rolls have a combination of an inverse parabolic and quartic profile that results in an equivalent cubic roll profile during shifting. Since $b >> s_m$, the equivalent profile in the range where $s_m \leqq x \leqq b$ is more dominant than the equivalent profile in the range where $0 \leqq x \leqq s_m$, where $s_m$ is the maximum work roll shifting stroke. FIGS. 29 and 30 show the variation of the coefficients $a_1$ and $a_2$ as function of n. FIG. 31 shows the equivalent work roll crown as function of the shifting stroke "s." As expected, an inversely symmetrical graph is the result.

The IVC mill family can be summarized for the case of a 2-hi, 4-hi and a 6-hi mill in Table 2. The "x" in Table 2 indicates the roll that is an IVC roll. The rolls that are not marked with an "x" are cylindrical.

TABLE 2

| | | Shifted Rolls | | | | | |
|---|---|---|---|---|---|---|---|
| Case No. | Mill Type | Top WR | Bot WR | Top IR | Bot IR | Top BUR | Bot BUR |
| 1 | 2 HI | x | x | | | | |
| 2 | 4 HI | x | x | | | | |
| 3 | | | | | | x | x |
| 4 | | x | x | | | x | x |
| 5 | 6 HI | x | x | | | | |
| 6 | | | | x | x | | |
| 7 | | | | | | x | x |
| 8 | | x | x | x | x | | |
| 9 | | | | x | x | x | x |
| 10 | | x | x | | | x | x |
| 11 | | x | x | x | x | x | x |

Figure 34:
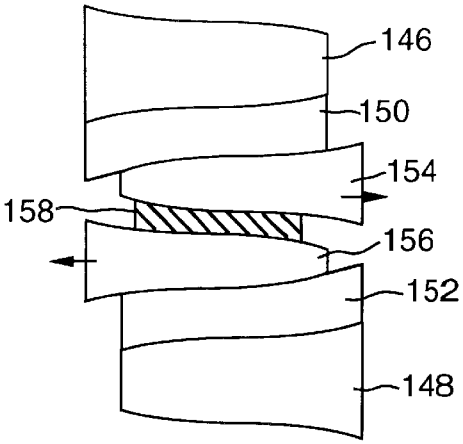
FIG. 34 is a schematic cross-sectional illustration of a 6-hi mill stand of the present invention with IVC work and backup rolls having perfect contact with their associated intermediate roll and shifted to produce a strip with a concave profile.
Figure 33:
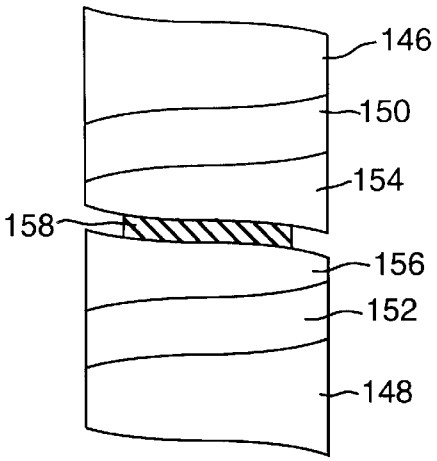
FIG. 33 is a schematic cross-sectional illustration of a 6-hi mill stand of the present invention with IVC work and backup rolls having perfect contact with their associated intermediate roll and positioned to produce a generally flat strip.
Figure 32:
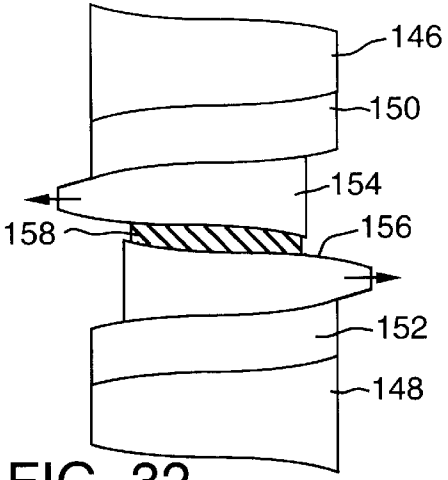
FIG. 32 is a schematic cross-sectional illustration of a 6-hi mill stand of the present invention with IVC work and backup rolls having perfect contact with their associated intermediate roll and shifted to produce a strip with a convex profile.
Figure 34A:
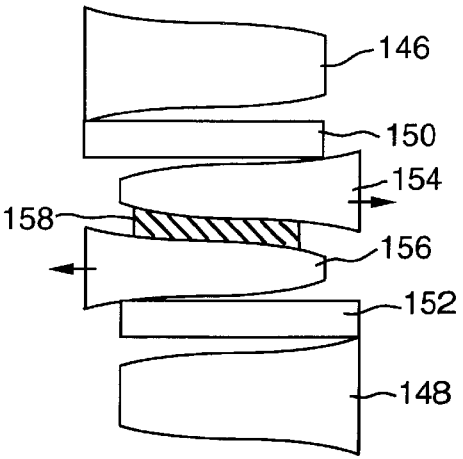
FIG. 34*a* is a schematic cross-sectional illustration of the mill stand of FIG. 34 with interface mismatch.
Figure 33A:
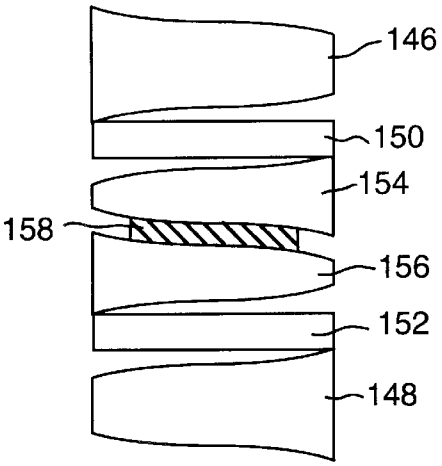
FIG. 33*a* is a schematic cross-sectional illustration of the mill stand of FIG. 33.
Figure 32A:
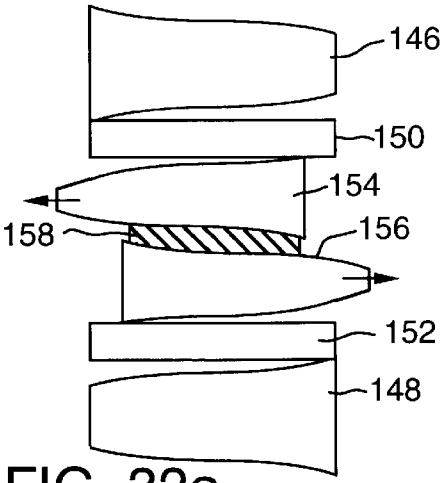
FIG. 32*a* is a schematic cross-sectional illustration of the mill stand of FIG. 32 with interface mismatch.

In Table 2 the following abbreviations are used:
WR = work roll
IR = intermediate roll
BUR = backup roll
Bot = bottom or lower
Top = top or upper For example, Case No. 10 is illustrated in FIGS. 32–34. Case No. 10 illustrates a mill stand having IVC backup rolls 146 and 148 cylindrical, intermediate rolls 150 and IVC 152 and work rolls 154 and 156. Between work rolls 154 and 156 is metal strip 158. FIGS. 32*a*–34*a* show the mill stands of FIGS. 32–34 with interface mismatch.

The IVC mill family is inclusive of mills having IVC rolls and cylindrical rolls. The IVC mill family can include other mills not represented in Table 2, such as an 8-hi or 10-hi mill. While 2-hi, 4-hi and a 6-hi mills are more common, an IVC mill of the present invention is not limited to only two work rolls, two intermediate rolls if necessary and two backup rolls if necessary. An IVC mill of the present invention may have more than two backup rolls or more than two intermediate rolls.

In the IVC mill family, shown in Table 2, it is preferable that there by no interface mismatch in the mill, in other words, that there be contact between the associated rolls without interface mismatch. Interface mismatch between the rolls create contact stresses on the rolls. In order to reduce the interface mismatch between the associated rolls, all IVC rolls preferably have the same inverse symmetrical profile. However the IVC mill family does also include mills in which the IVC rolls in the same mill stand have inverse symmetrical profiles defined by different polynomial functions.

While there has been illustrated and described several embodiments of the present invention, it will be apparent that various changes and modifications thereof will occur to those skilled in the art. It is intended in the appended claims to cover all such changes and modifications that fall within the true spirit and scope of the present invention.

We claim:

1. A rolling mill comprising:

a housing for mounting rolls;

at least one upper backup roll having an inverse symmetrical profile;

an upper work roll oriented opposite from said at least one upper backup roll and contacting said at least one upper backup roll, the upper work roll having an inverse symmetrical profile;

a lower work roll spaced from said upper work roll and having a cylindrical profile;

at least one lower backup roll oriented opposite from the upper work roll and contacting the lower work roll, the at least one lower backup roll having an inverse symmetrical profile; and a means for shifting the upper work roll and the lower work roll in relation to the at least one upper backup roll and the at least one lower backup roll in said housing so as to create a family of strip profiles as a function of a roll shifting position.

2. The rolling mill of claim 1, wherein said rolls with an inverse symmetrical profile have inverse symmetrical profiles defined by different polynomial functions.

3. The rolling mill of claim 1, wherein the family of strip profiles created prior to shifting are strip profiles expressed by polynomial functions having terms of the $n^{th}$ order, where n is 1–5 inclusive, and the family of strip profiles produced by shifting the upper work roll having an inverse symmetrical profile are strip profiles expressed by polynomial functions having terms of the $(n-1)^{th}$ order, where n is preferably 1–5, inclusive.

4. The rolling mill of claim 1, wherein each of the rolls having an inverse symmetrical profile is defined by a polynomial function having a fourth order term and a second order term.

5. The rolling mill of claim 1, wherein the family of strip profiles created prior to shifting are strip profiles expressed by polynomial functions having terms of the $n^{th}$ order, where n is greater than 5, and the family of strip profiles produced by shifting the upper work roll having an inverse symmetrical profile are strip profiles expressed by polynomial functions having terms of the $(n-1)^{th}$ order, where n is greater than 5.

6. A 2-hi rolling mill comprising:

a housing for mounting rolls;

an upper work roll having an inverse symmetrical profile positioned above a metal strip to be rolled;

a lower work roll having an inverse symmetrical profile positioned below said metal strip to be rolled and oriented opposite from the upper work roll;

a means for shifting the upper work roll and the lower work roll in relation to each other in said housing so as to create a family of strip profiles as a function of a roll shifting position;

wherein the family of strip profiles created prior to shifting are strip profiles expressed by polynomial functions having terms of the $n^{th}$ order, where n is 4–5 inclusive, and the family of strip profiles produced by shifting the upper work roll having an inverse symmetrical profile and the lower work roll having an inverse symmetrical profile are strip profiles expressed by polynomial functions having terms of the $(n-1)^{th}$ order, where n is 4–5, inclusive.

7. The rolling mill of claim 6, wherein said rolls with an inverse symmetrical profile have inverse symmetrical profiles defined by different polynomial functions.

8. The rolling mill of claim 5, wherein each of the rolls having an inverse symmetrical profile is defined by a polynomial function having a fourth order term and a second order term.

9. The rolling mill of claim 6, wherein the inverse symmetrical roll profile, y, is expressed as follows:

for upward concavity $$y=a_1x^4+a_2x^2,$$

for downward concavity $$y=-a_1x^4-a_2x^2$$

where, $a_1$=coefficient for the $4^{th}$ order polynomial term $a_2$=coefficient for the $2^{nd}$ order polynomial term x=distance from roll center The coefficients $a_1$ and $a_2$ are calculated as follows:

$$a_1 = \frac{nC_{ecm}}{4s_m(n+1)[4b(b^2+s_m^2)-s_m^3]}$$

$$a_2 = \frac{C_{ecm}}{4s_m(n+1)(2b-s_m)}$$

where, $s_m$ = maximum work roll shifting stroke $C_{ecm}$ = maximum equivalent work roll crown for maximum shifting stroke $n$ = distribution factor between quadratic and quartic component of roll profile $b$ = half of the roll body length.

10. A rolling mill comprising:

a housing for mounting rolls;

an upper roll having an inverse symmetrical profile positioned above a metal strip to be rolled;

at least one other roll above a metal strip to be rolled selected from the group consisting of a roll with an inverse symmetrical profile and a cylindrical roll;

a lower roll having an inverse symmetrical profile positioned below said metal strip to be rolled;

at least one other roll below a metal strip to be rolled selected from the group consisting a roll with an inverse symmetrical profile and a cylindrical roll;

a means for shifting at least one roll having an inverse symmetrical profile above the metal strip to be rolled and at least one lower roll having an inverse symmetrical profile below a metal strip to be rolled, in relation to each other in said housing, so as to create a family of strip profiles as a function of a roll shifting position;

wherein the family of strip profiles created prior to shifting are strip profiles expressed by polynomial functions having terms of the $n^{th}$ order, where n is 4–5 inclusive, and the family of strip profiles produced by shifting at least one upper roll having an inverse symmetrical profile and at least one lower roll having an inverse symmetrical profile are strip profiles expressed by polynomial functions having terms of the $(n-1)^{th}$ order, where n is 4–5, inclusive.

11. The rolling mill of claim 10, wherein said rolling mill is a 4-hi mill.

12. The rolling mill of claim 11, wherein said rolling mill is selected from the group consisting of: a mill with two work rolls with inverse symmetrical profiles and two cylindrical backup rolls; a mill with two cylindrical work rolls and two backup rolls with inverse symmetrical profiles; and a mill with two work rolls with inverse symmetrical profiles and two backup rolls with inverse symmetrical profiles.

13. The rolling mill of claim 10, wherein said rolling mill is a 6-hi mill.

14. The rolling mill of claim 13, wherein said rolling mill is selected from the group consisting of: a mill with two work rolls with inverse symmetrical profiles, two cylindrical intermediate rolls and two cylindrical backup rolls; a mill with two cylindrical work rolls, two intermediate rolls with inverse symmetrical profiles and two cylindrical backup rolls; a mill with two cylindrical work rolls, two cylindrical intermediate rolls, and two backup rolls with inverse symmetrical profiles; a mill with two work rolls with inverse symmetrical profiles, two intermediate rolls with inverse symmetrical profiles and two cylindrical backup rolls; a mill with two cylindrical work rolls, two intermediate rolls with inverse symmetrical profiles and two backup rolls with inverse symmetrical profiles; a mill with two work rolls with inverse symmetrical profiles, two cylindrical intermediate rolls, and two backup rolls with inverse symmetrical profiles; and a mill with two work rolls with inverse symmetrical profiles, two intermediate rolls with inverse symmetrical profiles and two backup rolls with inverse symmetrical profiles.

15. The rolling mill of claim 10, wherein the inverse symmetrical roll profile, y, is expressed as follows:

for upward concavity $$y=a_1x^4+a_2x^2,$$

for downward concavity $$y=-a_1x^4-a_2x^2$$

where, $a_1$=coefficient for the $4^{th}$ order polynomial term $a_2$=coefficient for the $2^{nd}$ order polynomial term x=distance from roll center The coefficients $a_1$ and $a_2$ are calculated as follows:

$$a_1 = \frac{nC_{ecm}}{4s_m(n+1)[4b(b^2+s_m^2)-s_m^3]}$$

$$a_2 = \frac{C_{ecm}}{4s_m(n+1)(2b-s_m)}$$

where, $s_m$ = maximum work roll shifting stroke $C_{ecm}$ = maximum equivalent work roll crown for maximum shifting stroke $n$ = distribution factor between quadratic and quartic component of roll profile $b$ = half of the roll body length.

16. A method of operating a rolling mill comprising:

providing a rolling mill having:

a housing for mounting rolls;

at least one upper backup roll having an inverse symmetrical profile;

an upper work roll oriented opposite from said at least one upper backup roll and contacting said at least one upper backup roll, the upper work roll having an inverse symmetrical profile;

a lower work roll spaced from said upper work roll and having a cylindrical profile;

at least one lower backup roll oriented opposite from the upper work roll and contacting the lower work roll, the at least one lower backup roll having an inverse symmetrical profile;

a means for shifting the upper work roll and the lower work roll in relation to the at least one upper backup roll and the at least one lower backup roll in said housing so as to create a family of strip profiles as a function of a roll shifting position; and a means for regulating the vertical position of the at least one upper backup roll;

shifting the upper work roll from a first position to a second position;

measuring the distance from the first position to the second position;

generating a first output signal based on the measured distance;

calculating two standard reference signals from the means for regulating the vertical position of the at least one upper backup roll;

adding the two standard reference signals to two actual position signals, representing the actual position of the means for regulating the vertical position of the at least one upper backup roll, to produce two total signals;

comparing the two total signals with two actual cylinder feedback signals, representing the actual position of the means for vertical regulation after shifting the work roll;

producing a differential signal based on comparing the two total signals with two actual cylinder feedback signals; and adjusting the vertical position of the upper backup roll based on the differential signal.

17. The method according to claim 16 wherein the means for regulating the vertical position of the at least one upper backup roll are hydraulic cylinders.

* * * * *